US006767314B2

(12) United States Patent
Thompson

(10) Patent No.: US 6,767,314 B2
(45) Date of Patent: Jul. 27, 2004

(54) EXERCISE APPARATUS AND METHOD OF COLLAPSING THE SAME

(76) Inventor: Patrick A. Thompson, 1565 Freeman Rd., Hoffman Estates, IL (US) 60195

( * ) Notice: Subject to any disclaimer, the term of this patent is extended or adjusted under 35 U.S.C. 154(b) by 25 days.

(21) Appl. No.: 10/251,523

(22) Filed: Sep. 20, 2002

(65) Prior Publication Data

US 2004/0058788 A1 Mar. 25, 2004

(51) Int. Cl.[7] ..... A63B 21/068

(52) U.S. Cl. ..... 482/96; 482/72; 482/135; 482/141; 482/145; 482/904

(58) Field of Search ..... 482/72, 101, 92–96, 482/129, 130, 132, 135, 142, 145, 904

(56) References Cited

U.S. PATENT DOCUMENTS 682,988 A * 9/1901 Hazelip ..... 482/96
2,783,045 A * 2/1957 Bosch ..... 482/96
3,658,327 A 4/1972 Thiede
3,797,824 A * 3/1974 Osbourne ..... 482/132
3,892,404 A 7/1975 Martucci
4,004,801 A 1/1977 Campanaro et al.
4,101,124 A 7/1978 Mahnke
4,176,836 A 12/1979 Coyle
4,383,684 A * 5/1983 Schliep ..... 482/96
4,524,763 A 6/1985 Eberling, Jr.
4,582,320 A * 4/1986 Shaw ..... 482/130
4,759,539 A 7/1988 Neippola
4,911,438 A * 3/1990 Van Straaten ..... 482/96
5,518,487 A 5/1996 Hallmark
5,620,403 A 4/1997 Lundin
5,752,879 A 5/1998 Berdut
5,906,564 A 5/1999 Jacobsen
5,938,571 A 8/1999 Stevens
5,964,684 A 10/1999 Sokol
5,967,955 A 10/1999 Westfall et al.
6,015,369 A 1/2000 Rasmussen
6,024,677 A 2/2000 Siwertz
6,186,929 B1 * 2/2001 Endelman et al. ..... 482/121
6,217,483 B1 4/2001 Kallassy
6,238,322 B1 5/2001 Hsu
6,338,704 B1 1/2002 Endelman
2003/0119635 A1 * 6/2003 Arbuckle et al. ..... 482/142

FOREIGN PATENT DOCUMENTS

FR 2625907 A1 * 7/1989 ..... A63B/17/04

* cited by examiner

*Primary Examiner*—Nicholas D. Lucchesi
*Assistant Examiner*—Victor Hwang
(74) *Attorney, Agent, or Firm*—Christopher J. Scott; Charles F. Meroni, Jr.; Meroni & Meroni, P.C.

(57) ABSTRACT

The present invention provides a collapsible exercise apparatus, generally comprising a riser assembly, a carriage assembly, riser assembly support means, and peripheral attachments. The riser assembly further comprises a pair of parallel riser members and the carriage assembly further comprises a riser-engaging end. The riser-engaging end is received between the riser members in a carriage assembly-receiving track. The user may thus selectively incline the carriage assembly in the carriage assembly-receiving track in this operational state for exerting muscular effort against varying degrees of the user's own body weight resistance to achieve some level of physical activity or as part of an otherwise regular exercise regimen. To enable easy horizontal transferability, for example, during shipping or when not in use, the carriage assembly is easily nested within the carriage assembly-receiving track. Additionally, no tools are required to assemble or collapse the exercise apparatus.

23 Claims, 12 Drawing Sheets

Fig. 16
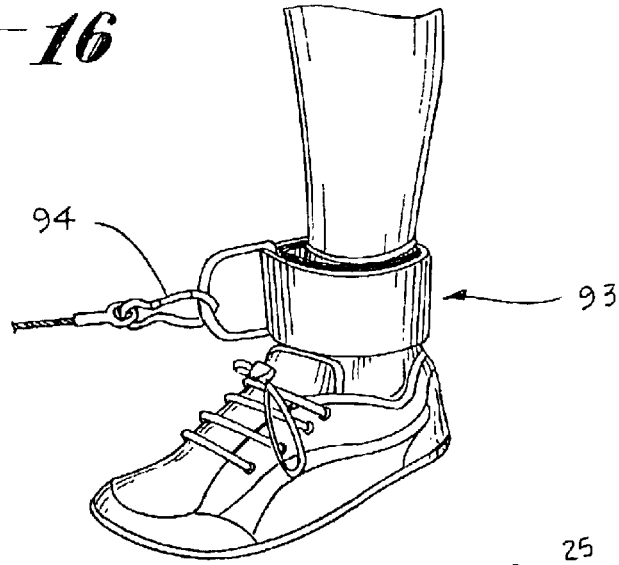
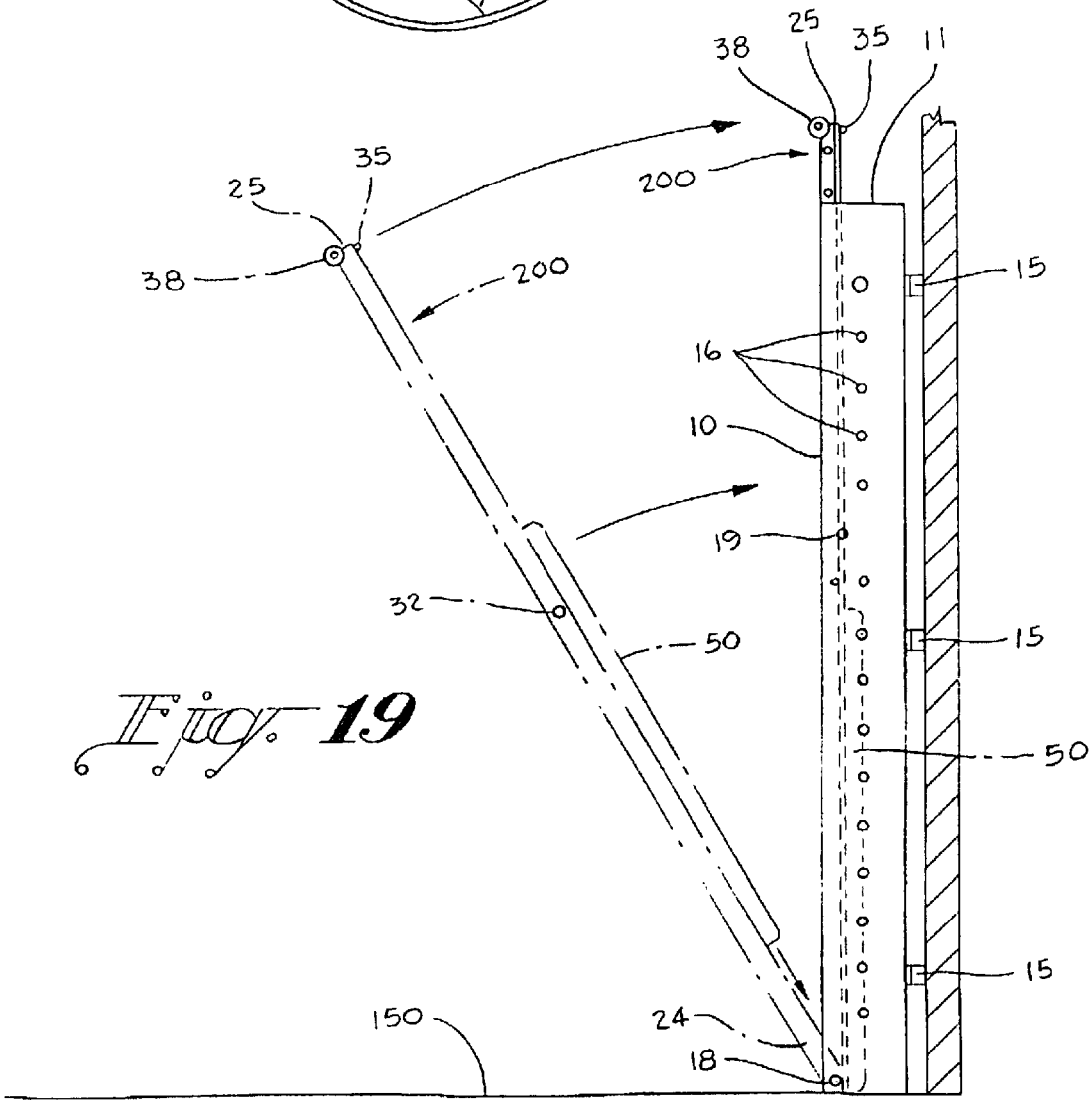
Fig. 19

EXERCISE APPARATUS AND METHOD OF COLLAPSING THE SAME

BACKGROUND OF THE INVENTION

1. Field of the Invention

The present invention generally relates to an exercise apparatus. More particularly, the present invention relates to an exercise apparatus of the type wherein the user exerts muscle effort against the user's own body weight resistance.

2. Description of the Prior Art

The United States Department of Health and Human Services has reported that as many as 250,000 human lives are lost annually in the United States as a result of a sedentary lifestyle or a lifestyle lacking in physical activity.[1] Indeed, lack of physical activity is now considered as important a risk factor for heart disease as high blood cholesterol, high blood pressure, and cigarette smoking, not because physical activity is a potent panacea, but because the number of inactive or sedentary people is so large.[2] The United States Centers for Disease Control and Prevention further report that inactivity resulting from a sedentary lifestyle contributes to approximately one-third of all heart-disease related deaths and costs billions in medical care every year.[3]

It has long been understood and it is now more or less undisputed that regular moderate physical activity and exercise can convey many important health benefits. From a public health standpoint, an increase in physical activity provides some level of protection from heart disease, hypertension, adult-onset diabetes, certain cancers, osteoporosis, depression, and premature aging, to name but a few ailments.[4] In an effort to enable the public to increase its collective level of physical activity, myriad exercise apparatuses have been developed. Of the myriad exercise apparatuses that have been developed, many comprise a translational support platform or carriage for supporting the weight of a positioned user, which platform or carriage is selectively inclinable and which positioned user may dynamically move the weighted support platform or carriage to and fro by way of cord/pulley means for movement. Furthermore, it is noted that many of the exercise apparatuses comprising translational, inclinable, user-bearing carriages, are foldable or collapsible for easy storage or shipment of the respective exercise apparatus. Several of these known apparatuses are described hereinafter.

U.S. Pat. No. 3,658,327 ('327 patent), which issued to Thiede, discloses a Pull Type Exercising Device. The Pull Type Exercising Device comprises a pair of deck portions selectably disposed in extended end-to-end relation for use and which may be stored or shipped in adjacent relation. One end of the extended deck is supportable on the ground or floor with the opposite end thereof detachably engaging a selectable rung of a support ladder. A carriage travels along rails on the extended deck, and the carriage is movable with respect to the deck by means of pulleys connected thereto.

U.S. Pat. No. 3,892,404 ('404 patent), which issued to Martucci, discloses an Exercise Device. The Exercise Device comprises adjustable, variable length tracks having a first end supported on a supporting surface, and the other opposite second end being supported by a track elevator, for supporting the tracks in angular relation with the supporting surface. A carriage is movably mounted on the tracks for supporting the body weight of a user. Exercise-enabling structure is mounted in the area adjacent the second end whereby a user positioned on the carriage may engage the exercise-enabling structure and dynamically place his or her body weight in to and fro motion along the tracks via the carriage, thereby enabling exercise of every major muscle group. The Exercise Device may be further outfitted with cord/pulley means for movement for further enabling exercise of select muscle groups.

U.S. Pat. No. 4,004,801 ('801 patent), which issued to Campanaro et al., discloses an Isotonic Exercise Unit wherein a pair of rigidly connected spaced rails are selectively elevated at one end to define an incline. A flat carriage is rollable on the rails and further comprises pulley lines and a foot retainer for drawing the carriage and the body of a positioned user upward along the incline by the physical exertion of the user.

U.S. Pat. No. 4,101,124 ('124 patent), which issued to Mahnke, discloses a Pull Type Exercising Device. The Pull Type Exercising Apparatus comprises an inclined track assembly, the upper end of which comprises a pair of lockable guide sleeves, which telescopically receive the legs of a U-shaped track elevator member. Movement of the guide sleeves up and down the legs of the elevator member varies the angle of inclination of the track assembly. The user thus may position himself or herself on a carriage and exert forces against his or her own weight by pulling or pushing the carriage along the inclined track assembly.

U.S. Pat. No. 5,906,564 ('564 patent), which issued to Jaconsen, discloses an Adjustable Incline Traveling Platform Exercise Apparatus. The Adjustable Incline Traveling Platform Exercise Apparatus comprises a wheeled rolling platform which moves on an inclined frame and includes an adjustable arm cord mounting assembly. The arm cord mounting assembly includes a pair of elongated arm cords each entrained over a fixed pulley mounted in each adjustable upright corner post. An anchoring device attaches the cords to the mobile platform. The platform moves on the frame against a resistance force provided by the body weight of the user positioned on the platform and the upward angled slope of the incline frame.

U.S. Pat. No. 5,938,571 ('571 patent), which issued to Stevens, discloses a Folding Exercise Machine. The Folding Exercise Machine comprises a frame with parallel rails and a glide board slidably mounted upon the frame. The glide board further comprises a plurality of wheels defining concave surfaces in rolling engagement upon the parallel rails. The user, after positioning himself or herself upon the glide board, operatively moves the glide board by engaging cord/pulley means for movement and exerting muscular effort against the user's own body weight resistance. The Folding Exercise Machine has folding structure intermediate the length of the parallel rails.

U.S. Pat. No. 5,967,955, which issued to Westfall et al. and assigned to Total Gym Fitness, Ltd. of West Chester, Pa., discloses a Collapsible Exercise Device. The Collapsible Exercise Device, more commonly known in the marketplace as the TOTAL GYM brand exercise apparatus, teaches an exercise apparatus comprising a vertical support member, first and second sets of rails adjustably supported by the vertical support member, a user support platform with rollers engaging the first and second sets of rails, pulley means, and cable connector means extending through the pulley means and connected to the user support platform. The cable connector means thus allow a user, positioned atop the user support platform, to dynamically vibrate the weighed support platform to and fro along the first and second sets of rails. To enable further exercise, the Collapsible Exercise Device may further comprise a foot rest at one end of the second set of rails, a foot harness attached to the cable connector means, and footholder or pull-up bars attachable to the first set of rails. As suggested by its title, the Collapsible Exercise Device is foldable to allow for easy storage.

U.S. Pat. No. 6,015,369, which issued to Rasmussen, discloses a Fitness Sled Exercise Machine. The Fitness Sled Exercise Machine comprises frame members which support a rail, which rail is attached to a foldable frame standard. The rail directs and contains the reciprocal travel of a body bearing carriage. Machine motion is vibrational in nature, beginning at a point of origin, translating to a point of differing elevation, and returning to its point of departure. A user employs muscular effort of the arms or legs to move the carriage against gravitational forces. A system of levers, pulleys and lines function to convert arm and leg muscular forces to carriage motion. The frame standard is 90 degrees foldable for shipping, but may be locked in vertical position for operation.

U.S. Pat. No. 6,024,677, which issued to Siwertz, discloses an Apparatus for Physical Exercise. This invention comprises a support wherein a sliding seat is supported on a rail, the rail being adjustable to permit the seat sliding travels in desired angles to a horizontal plane, and two pulley cables are attached in the support and longitudinally adjustable. The load of the pulley cables being adjusted as desired by threading the cables in alternative running paths in the apparatus, and through which pulley cables the user moves his body along the rail while resting on the seat for training the muscles of arms, legs and body exclusively against the load of his own body weight.

U.S. Pat. No. 6,238,322, which issued to Hsu, discloses an Exercise Machine Having a Sliding Seat Selectively Coupled to a Sliding Damping Member. This invention comprises a frame on which a load mechanism and a sliding seat pad are mounted. The load mechanism is formed of a damping member and a slide member fastened with the damping member. The sliding seat pad has a link portion. The slide member is provided with a traction portion capable of coupling and uncoupling with the link portion of the sliding seat pad. The frame is further provided with a pull cord capable of pulling the seat pad at the time when the pull cord is pulled.

Of the numerous exercise apparatuses that have been developed, many enable muscular exercise by way of providing varying levels of body weight resistance. In this regard, it has been shown that exercise apparatuses are known in the prior art in which a user, positioned on a reciprocating support platform or carriage, may translate the support platform back and forth or dynamically vibrate one's supported body weight to and fro along a selectively inclinable track, thus exercising those muscle groups enabling movement. The user may thus orient his or her person in a variety of positions on the support platform and engage varying exercise enabling structures with select body parts to operatively translate the weighted support platform and thus isotonically train multiple muscle groups. Further, it has been shown that the prior art teaches inclined ramp exercise apparatuses, which may fold or collapse for easy storage.

In addition to often being exorbitantly priced, the numerous exercise apparatuses that have been developed are often cumbersome to practice or require a large amount of free space in which to operate in a given exercise setting. Further, the numerous exercise apparatuses that have been developed often do not fold or collapse into compact, nested arrangements for shipment or storage. It is further noted that tools are often required to assemble various structures of the prior art exercise apparatuses from a shipped state. Further, tools are often required to disassemble or collapse the prior art exercise apparatuses into a collapsed state, which state is virtually identical to the shipped state.

In this regard, it is noted that none of the prior art cited teaches an exercise apparatus comprising a pair of parallel riser members, which riser members define a carriage assembly-receiving track. It is further noted that none of the prior art teaches a foldable or collapsible exercise apparatus in which the carriage assembly-receiving track nestedly houses or accepts the entire carriage assembly when in a collapsed state for shipping or storage. Still further, it is noted that none of the prior art teaches an exercise apparatus, which may be assembled from a nested or shipped state without the use of tools, and then may be further collapsed back into a nested or shipping-like state without the use tools.

Still further, it is noted that none of the prior art teaches a parallel riser member assemblage, which assemblage provides attachment means for attaching arm or leg exercise-enabling structure, which attachment means is vertically variable at the user's election, and which arm or leg exercise-enabling structure operates independent of cord/pulley means. It is further noted that none of the prior art comprises riser member support means, which riser member support means may collapse such that the riser member support means rest in immediate adjacency to the riser members or in nested relation to the riser members for enabling more convenient shipment or storage. It is further noted that none of the prior art teaches a riser member assemblage, which defines a carriage assembly-receiving track and which further comprises a plurality of cooperative riser aperture pairings for selectively elevating a riser member attachment end of the carriage assembly via a riser rod. Still further, it is noted that none of the prior art teaches a carriage assembly comprising a plurality of cooperative bar aperture pairings, which enable users to exercise varying muscle groups via a tubular exercise bar. Further still, the prior art does not teach the use of a reversible foot platform, which foot platform attaches to a foot platform end of the carriage assembly for supporting a user's body weight when in an engaged superior position or for supporting the foot platform end in an elevated state when in an engaged inferior position.

The prior art thus perceives a need for an exercise apparatus, which is low in cost, easy to operate and requires a minimal amount of free space in which to operate in a given exercise setting. Further, the prior art perceives a need for an exercise apparatus comprising a multi-purpose riser member assemblage. In this last regard, the prior art perceives a need for a riser member assemblage, which primarily provides variable vertical support to a carriage assembly when in an operational state and primarily provides a sturdy structural housing for the carriage assembly and all peripheral attachments when in a collapsed state.

Further, the prior art perceives a need for an exercise apparatus, which may be assembled from a nested or shipped state without the use of tools, and the may be further collapsed back into a nested or shipping-like state without the use tools. Still further, the prior art perceives a need for a parallel riser member assemblage, which assemblage provides attachment means for attaching arm or leg exercise-enabling structure, which attachment means is vertically variable at the user's election, and which arm or leg exercise-enabling structure operates independent of cord/ pulley means. Further, the prior art perceives a need for riser assembly support means, which riser assembly support means may collapse such that the riser assembly support means rest in immediate adjacency to the riser members or in nested relation to the riser members for enabling more convenient shipment or storage. Further, the prior art perceives a need for a riser member assemblage, which defines a carriage assembly-receiving track and which further comprises a plurality of cooperative riser aperture pairings for selectively elevating a riser member attachment end of the carriage assembly in the carriage-assembly-receiving track via a riser rod.

Still further, the prior art perceives a need for a carriage assembly comprising a plurality of cooperative bar aperture pairings, which pairings enable users to exercise varying muscle groups via a laterally-insertable tubular exercise bar. Further, the prior art perceives a need for a reversible foot platform, which foot platform attaches to a foot platform end of the carriage assembly for supporting a user's body weight when in an engaged superior position or for supporting the foot platform end in an elevated state when in an engaged inferior position.

SUMMARY OF THE INVENTION

Accordingly, it is an object of the present invention to provide an exercise apparatus, which is low in cost, easy to operate, and requires only a minimal amount of free space in which to operate in a given exercise setting. It is a further object of the present invention to provide an exercise apparatus comprising a multi-purpose riser member assemblage, which primarily provides variable vertical support to a carriage assembly when in an operational state and primarily provides a sturdy structural housing for the carriage assembly and all peripheral attachments when in a collapsed state to enable easier shipment and/or storage of the present invention. It is a further object of the present invention to provide an exercise apparatus, which comprises a parallel riser member assemblage, which assemblage provides attachment means for attaching arm or leg exercise-enabling structure, which attachment means is vertically variable at the user's election, and which arm or leg exercise-enabling structure operates independent of cord/pulley means. In this regard, it is an object of the present invention to provide an exercise apparatus with peripheral adjustable-height, direct tension cables for enabling appendage-dependent exercise. Still further, it is an object of the present invention to provide an exercise apparatus, which may be assembled from a nested or shipped state without the use of tools, which exercise apparatus may then be further collapsed back into a nested or shipping-like state without the use tools.

Still further, it is an object of the present invention to provide an exercise apparatus comprising riser assembly support means, which riser assembly support means may collapse such that the riser assembly support means rest in immediate adjacency to the riser members or in nested relation to the riser members for enabling more convenient storage and less costly shipping. It is a further object of the present invention to provide an exercise apparatus comprising a riser member assemblage, which defines a carriage assembly-receiving track and which further comprises a plurality of cooperative riser aperture pairings for selectively elevating a riser member attachment end of the carriage assembly in the carriage assembly-receiving track via a riser rod.

Still further, it is an object of the present invention to provide an exercise apparatus comprising a carriage assembly, which, in turn, comprises a plurality of cooperative bar aperture pairings. Said pairings thus enable users to exercise varying muscle groups via a removably insertable tubular exercise bar. Further still, it is an object of the present invention to provide an exercise apparatus comprising a dual-purpose, reversible foot platform, which foot platform attaches to a foot platform end of the carriage assembly for supporting a user's body weight when in an engaged superior position or for supporting the foot platform end in an elevated state when in an engaged inferior position.

To achieve these and other readily apparent objectives, the present invention provides a collapsible exercise apparatus, generally comprising a riser assembly, a carriage assembly, riser assembly support means, and peripheral attachments. The user of the present invention in an operational state may thus exert muscular effort against varying degrees of the user's own body weight resistance to achieve some level of physical activity or as part of an otherwise regular exercise regimen.

The riser assembly generally comprises a pair of parallel, vertical riser members and riser spacer means for maintaining the riser members in parallel relation. The riser spacer means thus create and maintain a uniform rail-receiving track between the riser members. The riser members each have a superior riser end, an inferior riser end, and a plurality of equally-spaced, laterally-aligned riser-rod-receiving apertures between the superior riser end and the inferior riser end. Each riser member has a rear portion and a front portion. The riser-rod-receiving apertures are aligned so as to have cooperative riser aperture pairing. The riser aperture pairing is designed, in relevant part, to cooperatively receive a rail-riser rod.

The carriage assembly generally comprises a rail assembly and a seat assembly. The rail assembly comprises a pair of parallel, angled rail members, rail spacer means for maintaining the rail members in parallel relation, a riser-engaging end and a foot platform end. The angled rail members each have a guide wheel portion and a runner wheel portion. The riser-engaging end has a pair of laterally-aligned rail-rod-receiving apertures. The rail-rod-receiving apertures have cooperative rail aperture pairing, which pairing is designed to cooperatively receive the rail-riser rod. The riser-engaging end is thus received in the rail-receiving track and the rail-riser rod is selectively and removably inserted laterally through a user-selected cooperative riser aperture pairing and the cooperative rail aperture pairing. By thus inserting the rail-riser rod, the user removably attaches the carriage assembly to the riser assembly for enabling exercise by way of selective levels of body weight resistance.

The seat assembly generally comprises a body support platform and roller means for movement. The body support platform has a body contact upper portion and a rail-engaging lower portion, the rail-engaging lower portion having a pair of laterally-spaced roller means attachment portions and a hover portion intermediate the laterally-spaced roller means attachment portions. The laterally-spaced roller means attachment portions each have a plurality of runner wheels and a plurality of guide wheels attached thereto. The runner wheels are spatially located for operative engagement with the runner wheel portions and the guide wheels are spatially located for operative engagement with the guide wheel portions.

The riser assembly support means generally comprises a rear support assembly, a front support assembly and lateral support means. The rear support assembly comprises a pair of rear stabilizer members and a pair of rear stabilizer rods. The rear stabilizer members each have an anterior rear end and a posterior rear end. The anterior rear ends are pivotally attached to the rear portions at the inferior riser end of the riser members. The rear stabilizer rods each have a rear stabilizer member attachment end and a rear riser member attachment end. The rear stabilizer member attachment ends are pivotally attached to the rear stabilizer members. The rear riser member attachment ends are designed for releasable fastening attachment to the riser members, thus enabling users to orient the rear stabilizer members at right angles to the riser members for providing rearward support to the riser assembly.

The front support assembly comprises a pair of front stabilizer members and a pair of front stabilizer rods. The front stabilizer members each have an anterior front end and a posterior front end, the posterior front ends being pivotally attached to the front portions at the inferior riser end of the riser members. The front stabilizer rods each have a front stabilizer member attachment end and a front riser member attachment end, the front stabilizer member attachment ends being pivotally attached to the front stabilizer members. The front riser member attachment ends are designed for releasable fastening attachment to the riser members, thus enabling users to orient the front stabilizer members at right angles to the riser members for providing frontal support to the riser assembly. The lateral support means are removably affixed to the inferior end to provide lateral support to the riser assembly.

The rail-riser rod may be further defined by comprising an insertion end and a hand-grip end. The insertion end is designed for selective and removable lateral insertion through user-selected cooperative riser aperture pairing and the cooperative rail aperture pairing. The hand-grip end is preferably outfitted with a hand-grip for enabling easy manual insertion or removal of the insertion end.

The angled rail members of the rail assembly each further comprise a plurality of spaced, laterally-aligned exercise bar-receiving apertures between the riser-engaging end and the foot platform end for receiving a peripheral exercise bar for enabling further muscular exercises.

The riser assembly further comprises a peripheral appendage exercise assembly for enabling various further exercises. The appendage exercise assembly comprises a cord-riser rod and a pair of cord assemblies. The cord-riser rod may be selectively inserted laterally through user-selected cooperative riser aperture pairing. The cord-riser rod has laterally-aligned cord assembly attachment ends, which extend laterally from the riser members when selectively inserted therethrough. The cord assemblies each comprise cord-riser rod attachment means, a length of cord, and an appendage-engaging assembly. The appendage-engaging assemblies each further comprise an appendage-engaging portion and cord attachment means. The appendage-engaging portions may either comprise a hand-engaging grip or an ankle-encircling harness, depending on the exercise the user may wish to practice. At least two sets of cord lengths are contemplated, the use of which depends on the exercise the user may wish to practice; disclosed is a long set of cord lengths and a short set of cord lengths.

The foot platform end may further comprise roller means for movement and a reversibly insertable foot platform assembly. The foot platform assembly comprises a foot platform and a platform flange. The platform flange is inserted into a flange-receiving sleeve laterally disposed intermediate the angled members. Thus, the reversibly insertable foot platform may support a user's body weight when in an engaged superior position, achieved by inserting the platform flange into the flange-receiving sleeve from a superior spatial location. The reversibly insertable foot platform may also support the foot platform end in an elevated state when in an engaged inferior position, achieved by inserting the platform flange into the flange-receiving sleeve from an inferior spatial location.

During shipment or when not in use, the present invention is foldable or collapsible, such that the entire carriage assembly and all peripheral attachments may be housed or nestedly received in the carriage assembly-receiving track, thus providing for a compact, nested arrangement for shipment or storage. In this last regard, vertically-oriented storage of the exercise apparatus may be more easily achieved. Further the riser assembly support means may be folded or collapsed to rest in snug adjacency to the riser assembly for easy shipment or storage. In this last regard, horizontal transferability of the collapsed present invention may also be more easily achieved.

Other objects of the present invention, as well as particular features, elements, and advantages thereof, will be elucidated in, or apparent from, the following description and the accompanying drawing figures.

BRIEF DESCRIPTION OF THE DRAWINGS

Other features of my invention will become more evident from a consideration of the following detailed description of my patent drawings, as follows:

FIG. No. 1 is a perspective view of the preferred embodiment of the exercise apparatus in an operational state.

Figure 1:
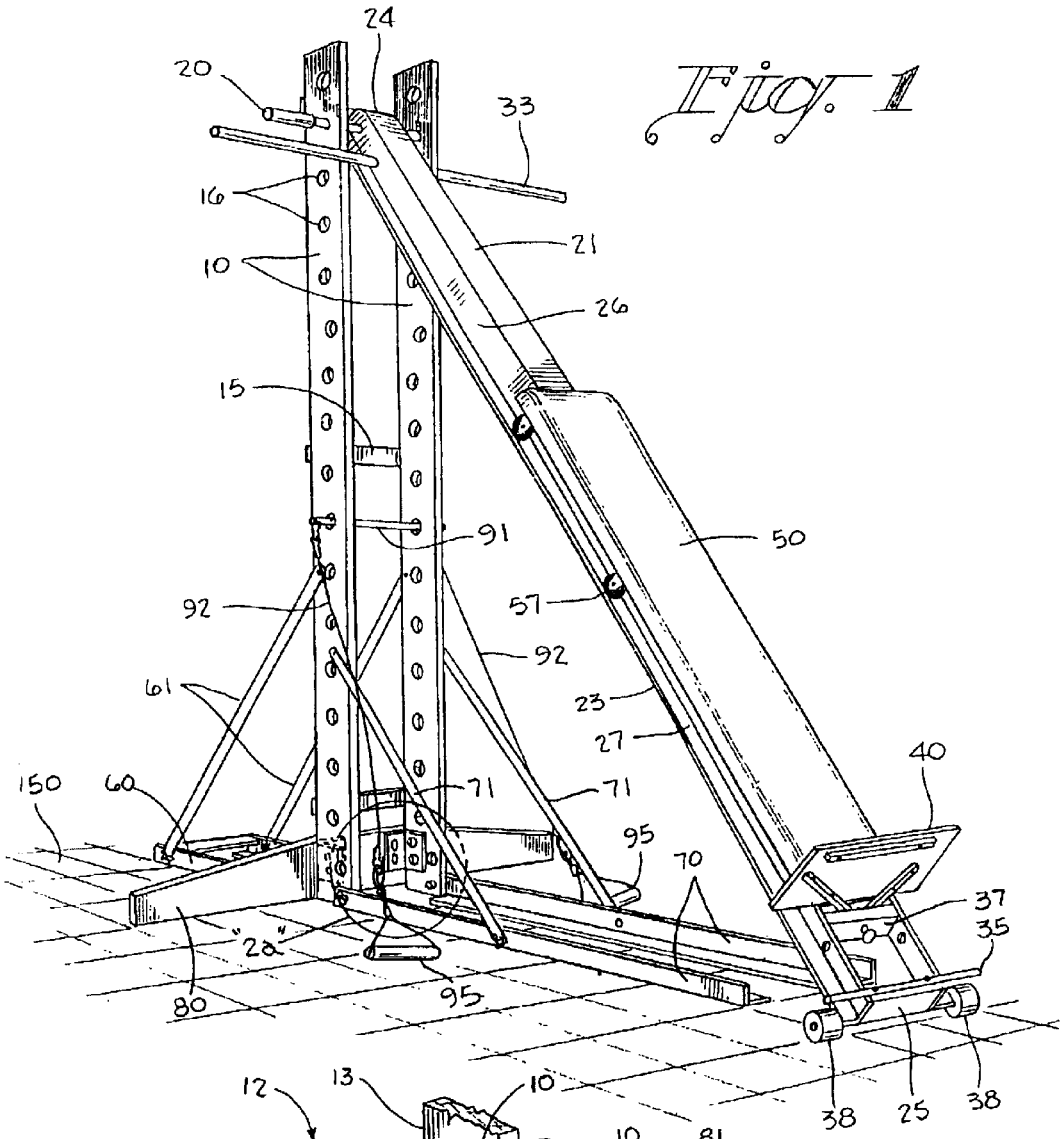
Figure 2A:
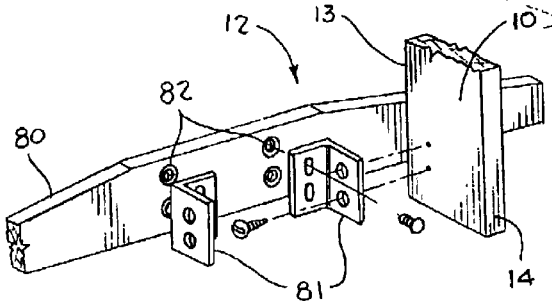
Figure 2B:
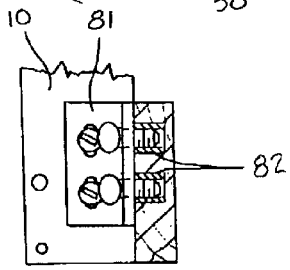
Figure 3:
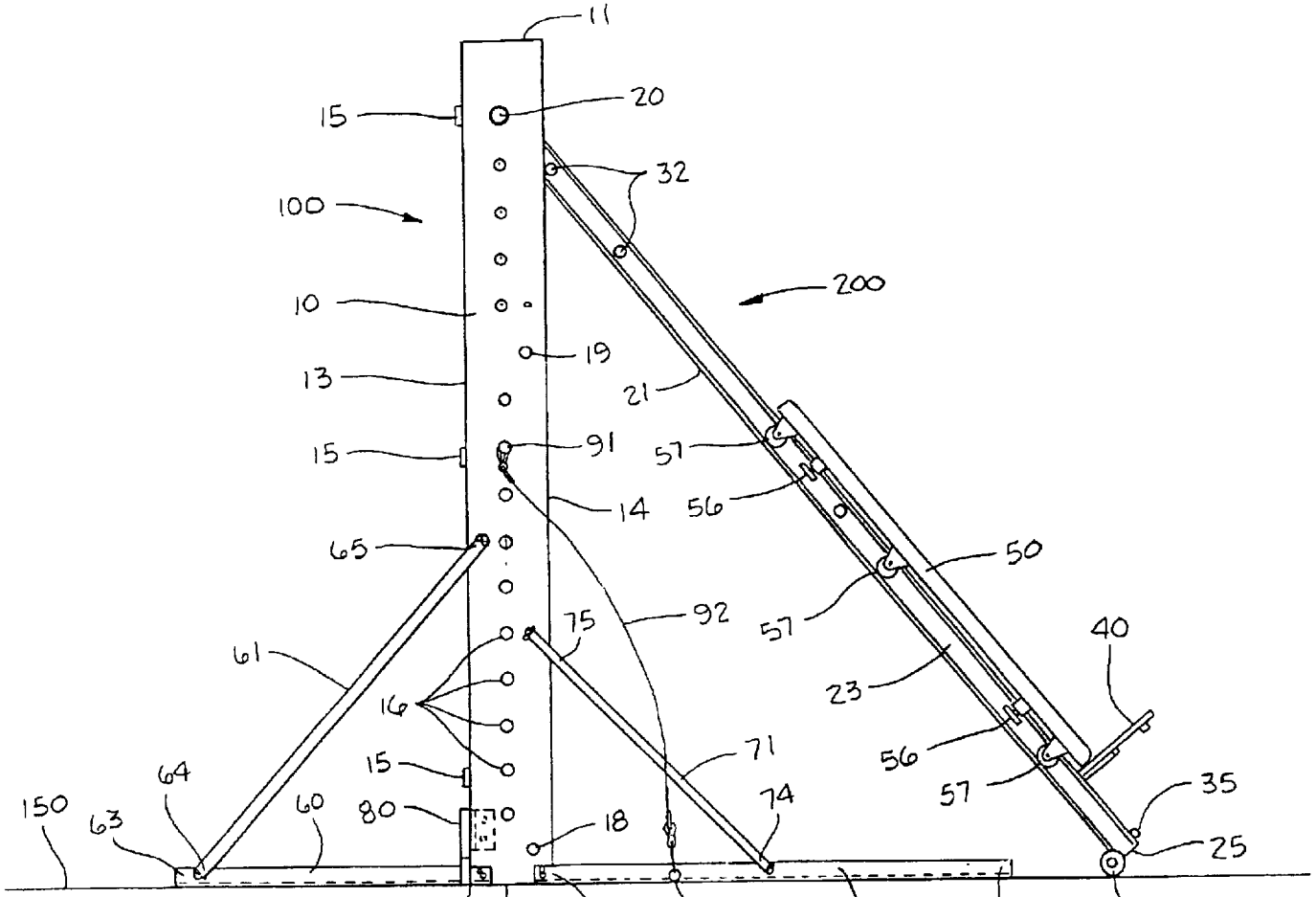
Figure 5:
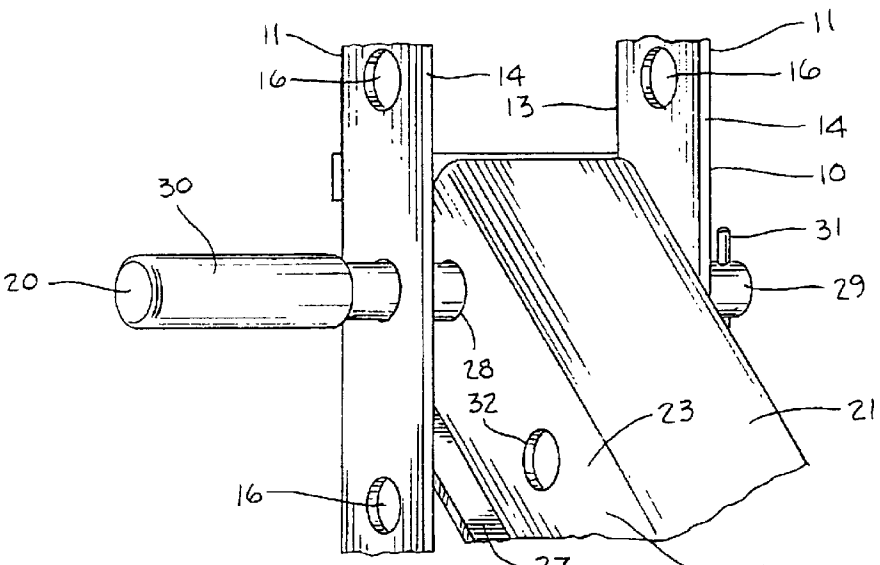
Figure 6:
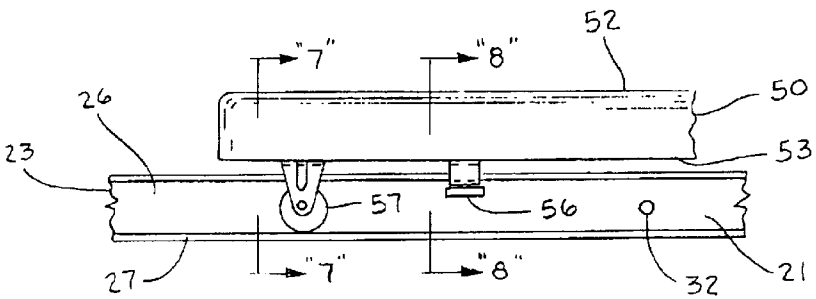
Figure 4:
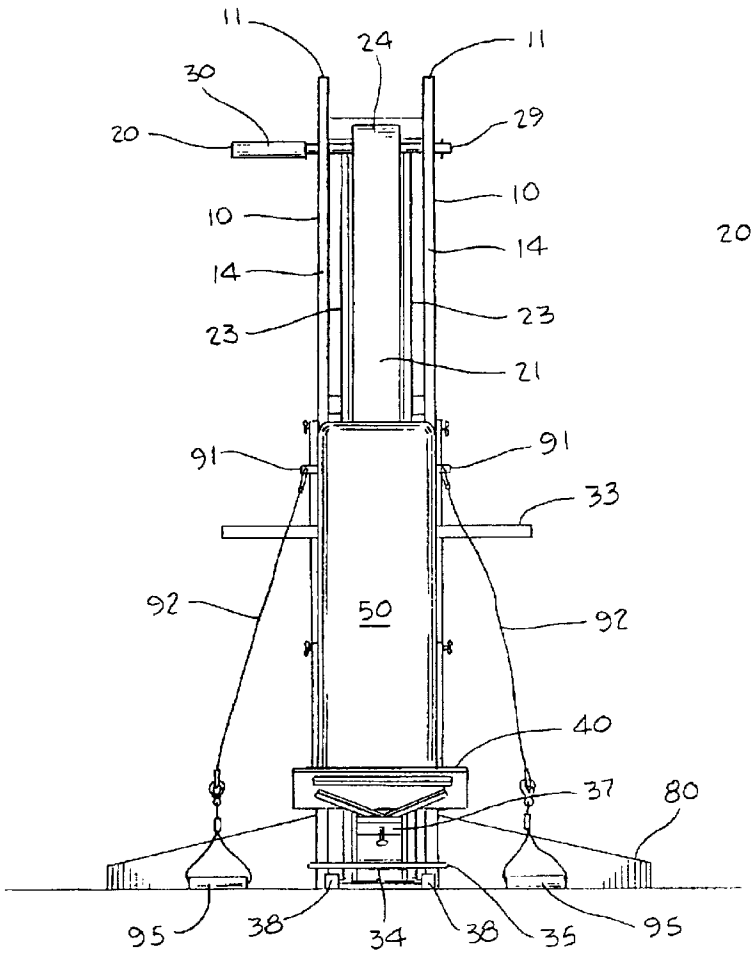
Figure 7:
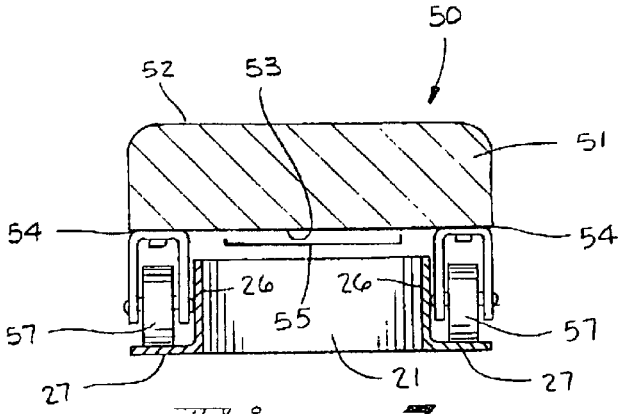
Figure 8:
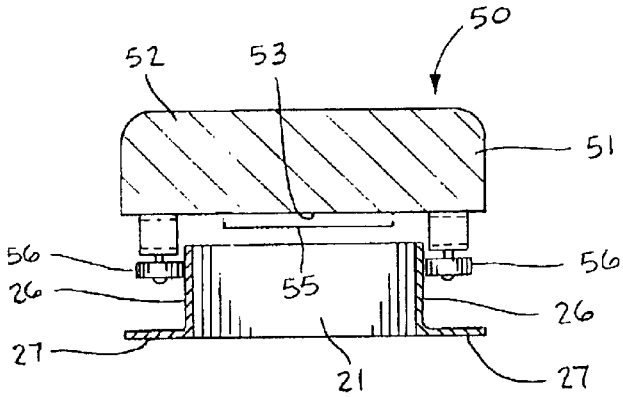
Figure 15A:
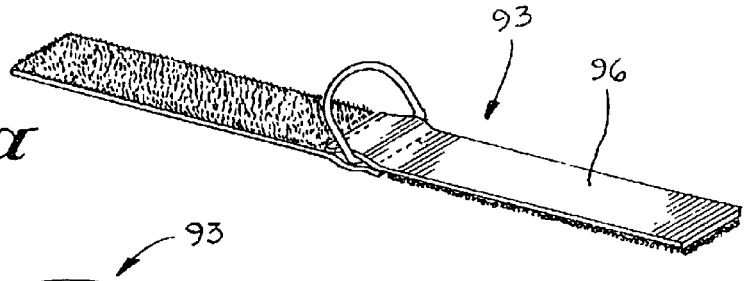
Figure 15B:
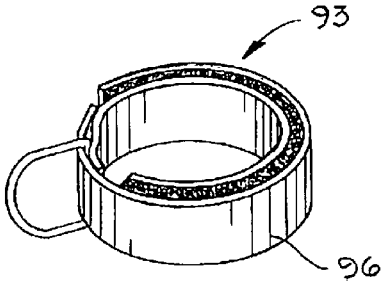
Figure 18:
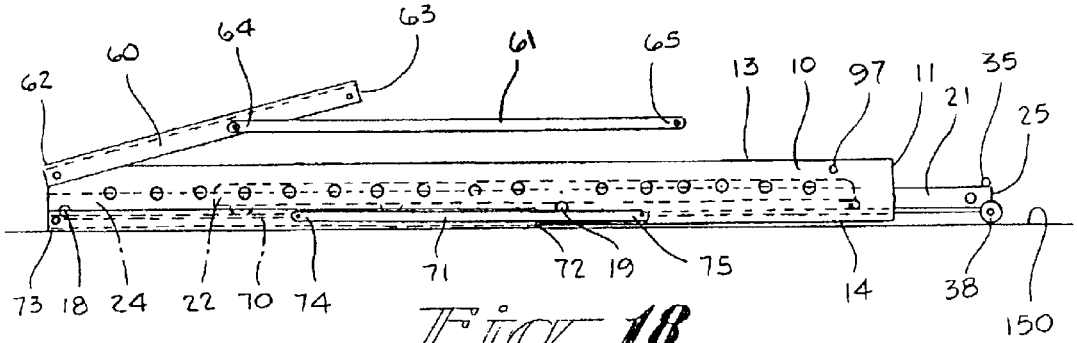
Figure 9:
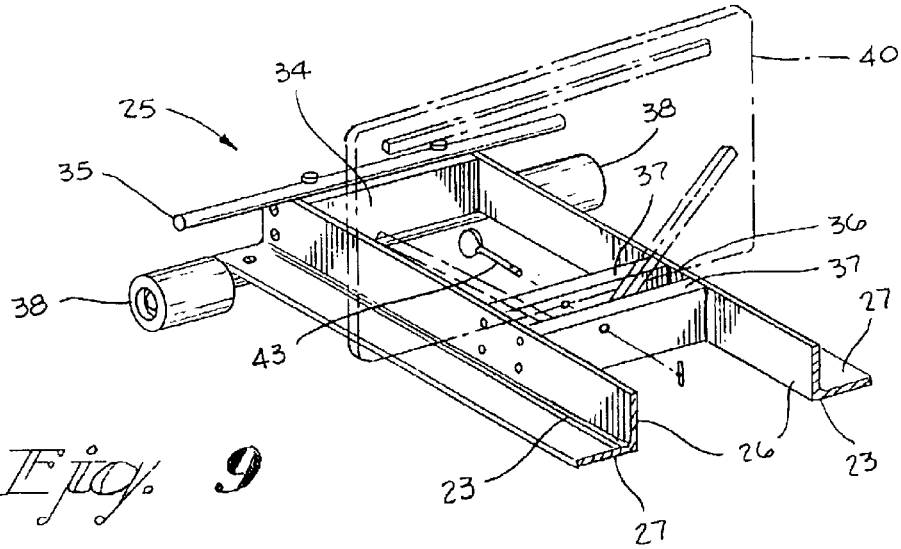
Figure 10:
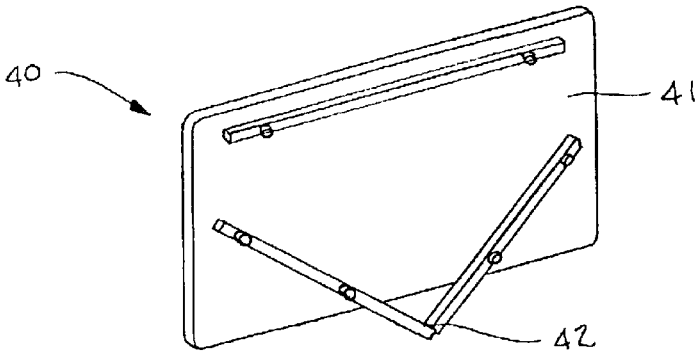
Figure 11:
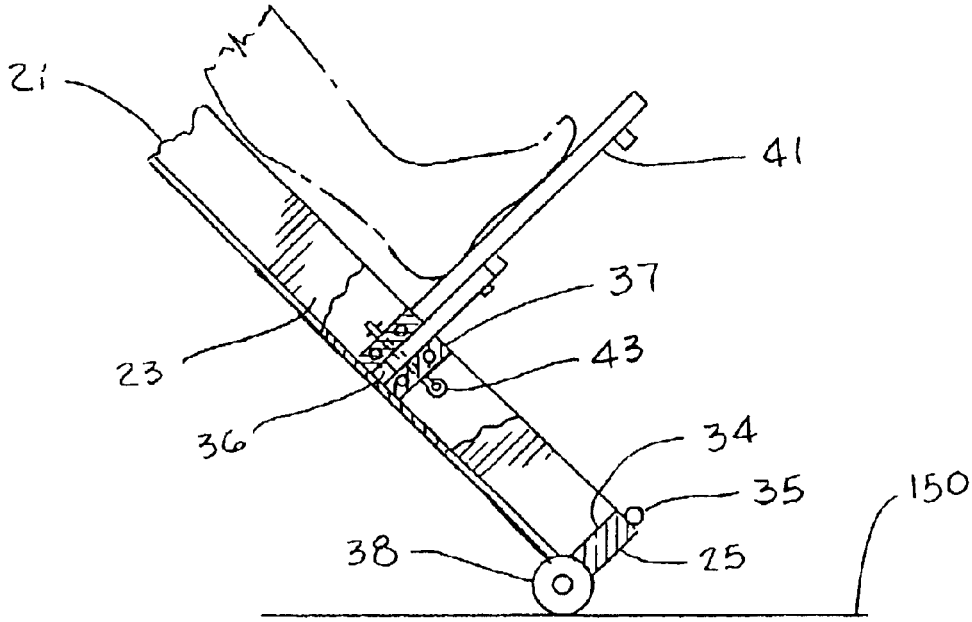
Figure 12:
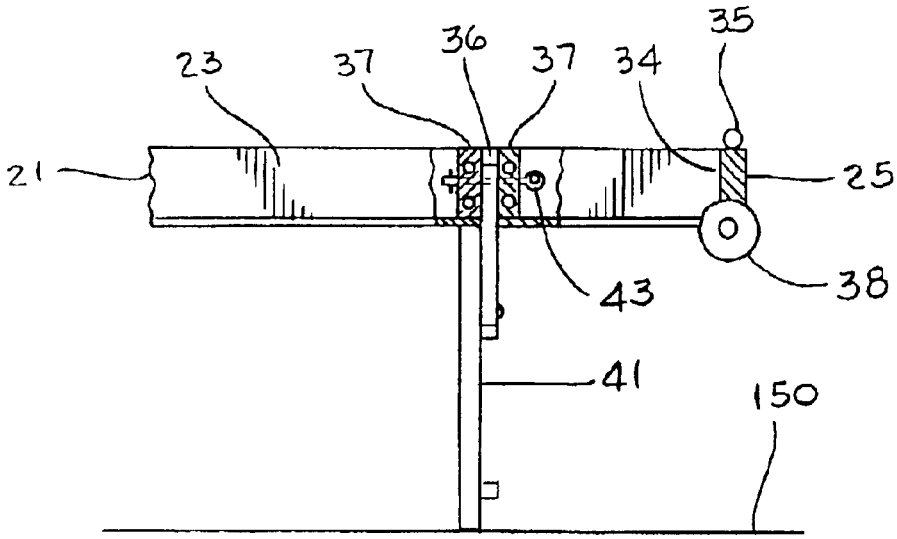
Figure 13:
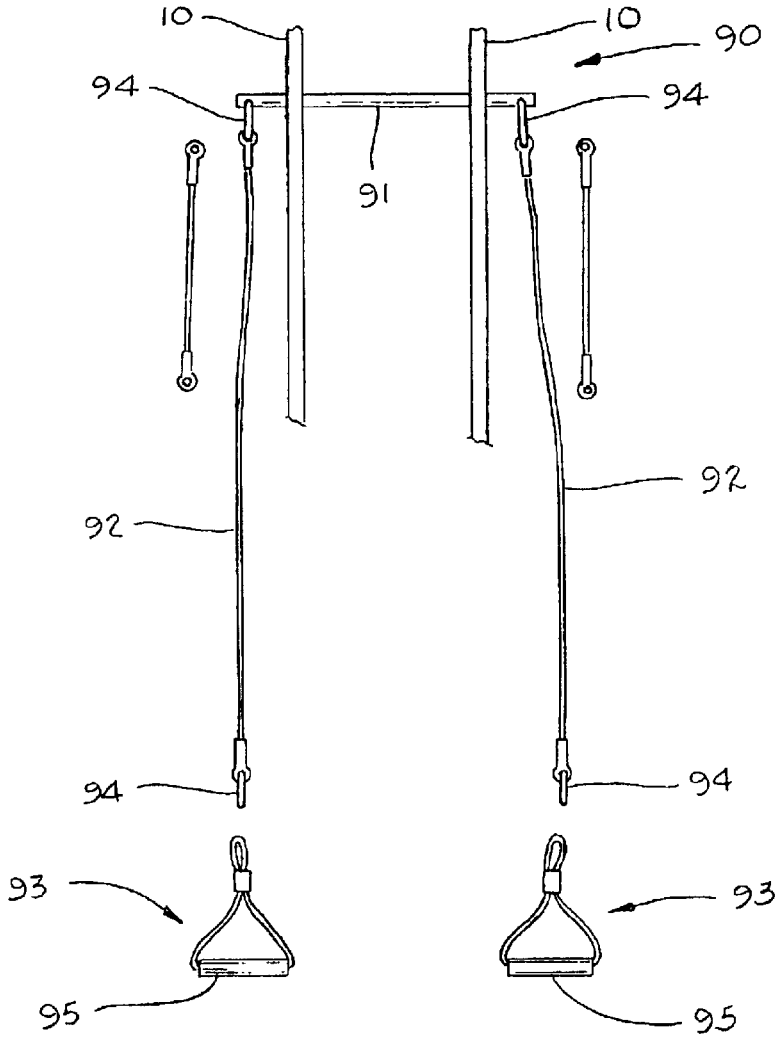
Figure 14:
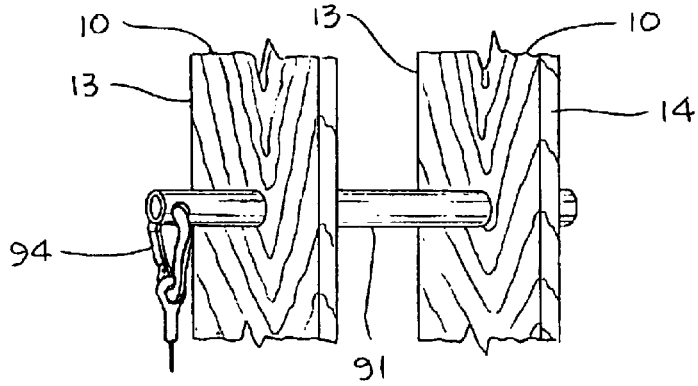
Figure 17:
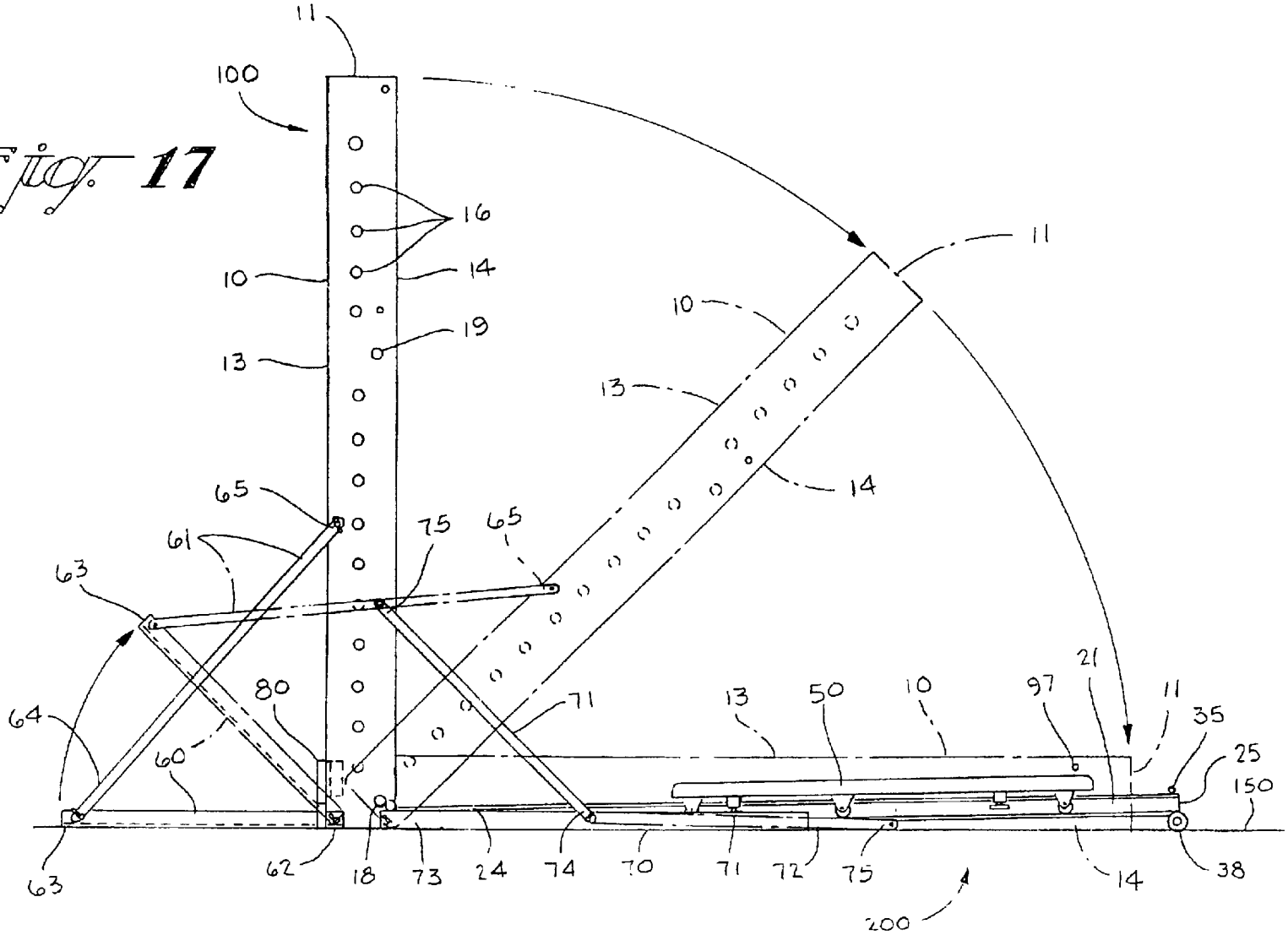
Figure 20:
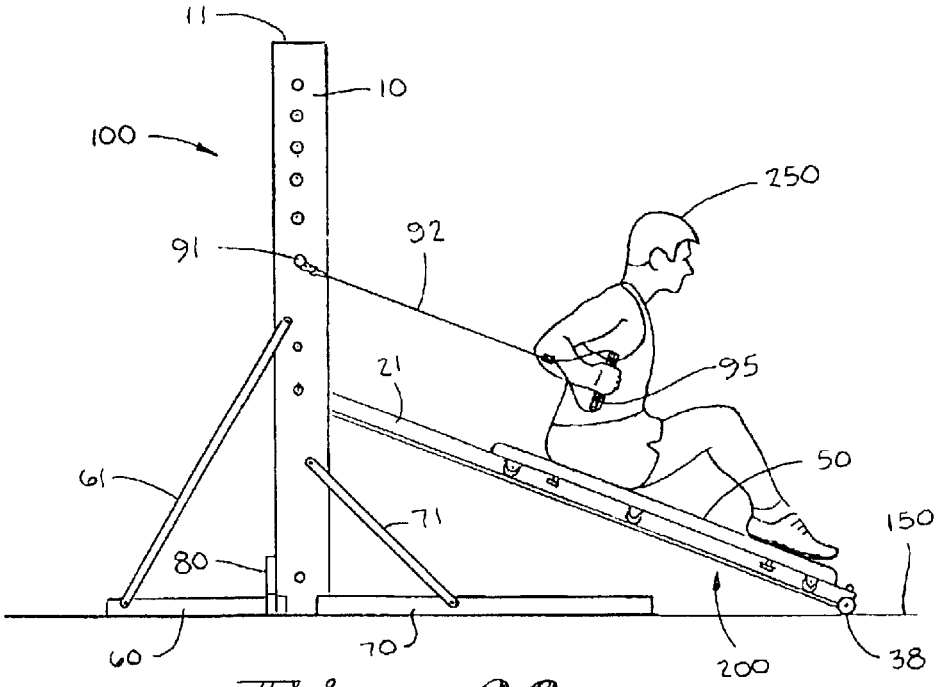
Figure 21:
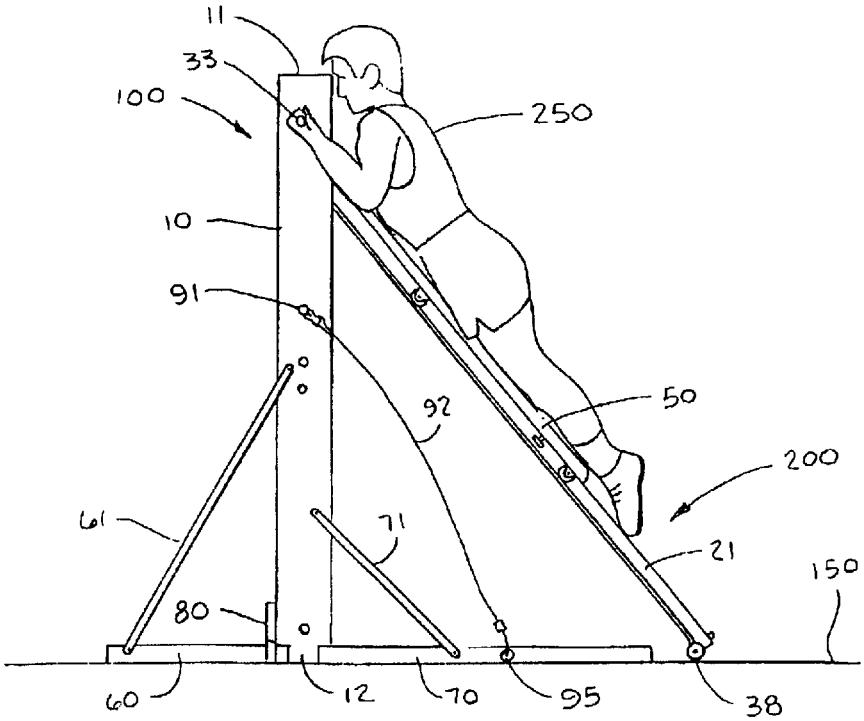
Figure 22:
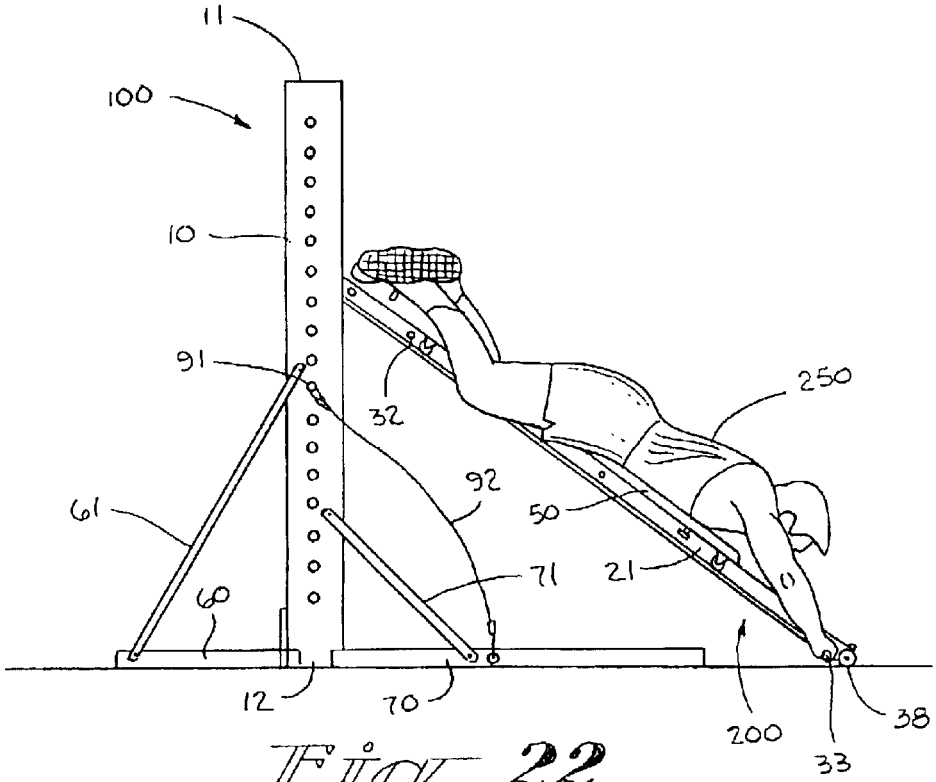
Figure 23:
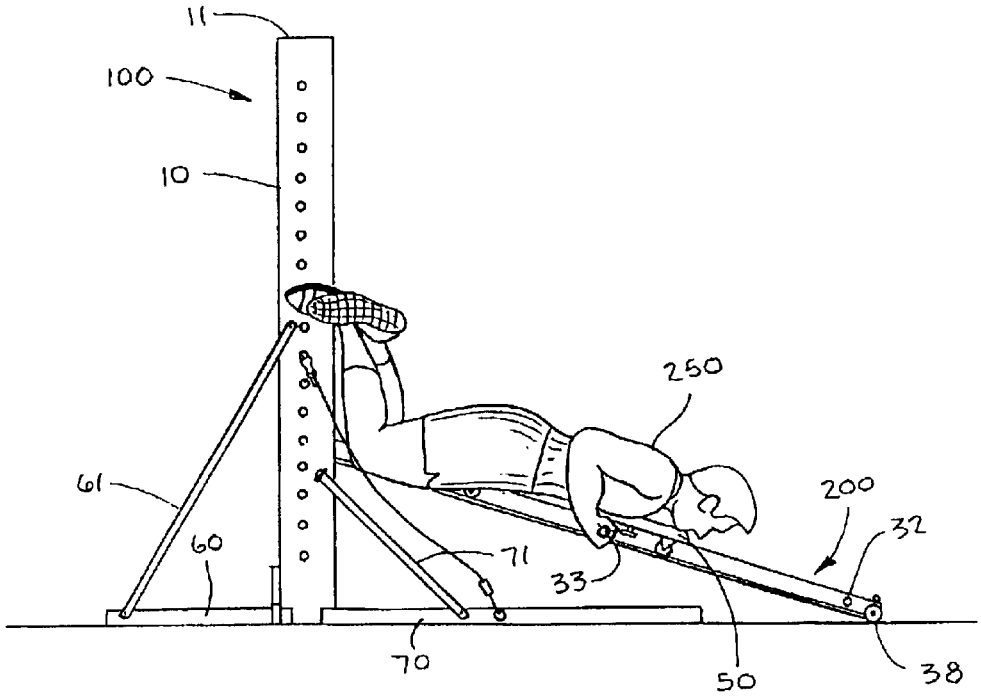
Figure 24:
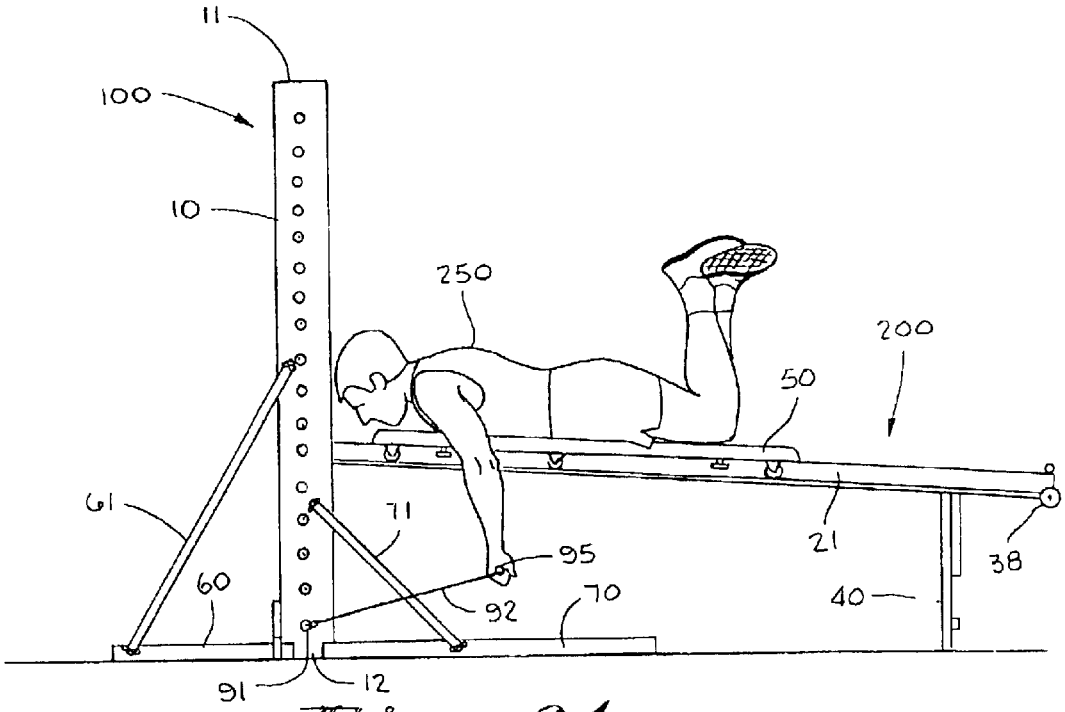
Figure 25:
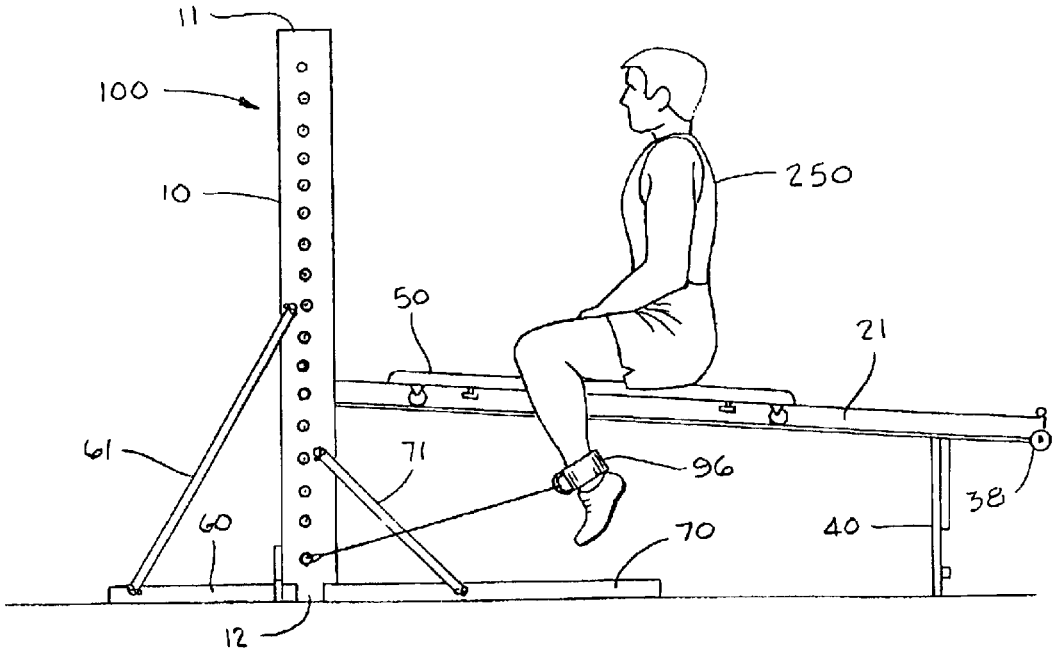

FIG. No. 2(*a*) is a fragmentary perspective view of the inferior end of the riser assembly with attached lateral support means.

FIG. No. 2(*b*) is a fragmentary cross-sectional view of the inferior end of the riser assembly with attached lateral support means.

FIG. No. 3 is a side plan view of the preferred embodiment of the exercise apparatus in an operational state.

FIG. No. 4 front plan view of the preferred embodiment of the exercise apparatus in an operational state.

FIG. No. 5 is a fragmentary perspective view of the riser-engaging end of the carriage assembly being attached to the riser assembly adjacent the superior riser end in the carriage assembly-receiving track via the rail-riser rod.

FIG. No. 6 is a fragmentary side plan view of the carriage assembly showing the seat assembly operatively engaged with the rail assembly.

FIG. No. 7 is a cross-sectional front view of the carriage assembly in FIG. No. 6, showing the seat assembly operatively engaged with the rail assembly at a runner wheel portion.

FIG. No. 8 is a cross-sectional front view of the carriage assembly in FIG. No. 6, showing the seat assembly operatively engaged with the rail assembly at a guide wheel portion.

FIG. No. 9 is a fragmentary perspective view of the foot platform end of the rail assembly with phantom foot platform assembly in an engaged superior position.

FIG. No. 10 is a perspective view of the foot platform.

FIG. No. 11 is a fragmentary side view of the foot platform end with parts broken away to show the junction of the foot platform assembly for supporting a user's body weight when in an engaged superior position.

FIG. No. 12 is a fragmentary side view of the foot platform end with parts broken away to show the junction of the foot platform assembly for supporting the foot platform end in an elevated state when in an engaged inferior position.

FIG. No. 13 fragmentary front view of the riser assembly with attached peripheral appendage exercise assembly, showing two cord lengths and hand-engaging grips.

FIG. No. 14 is a fragmentary perspective view of the riser assembly of FIG. No. 13 showing laterally inserted cable-riser rod and cord-riser rod attachment means.

FIG. No. 15(*a*) is a perspective view of an ankle-encircling harness in an open state.

FIG. No. 15(*b*) is a perspective view of an ankle-encircling harness in an encircling state.

FIG. No. 16 is a perspective view of an ankle-encircling harness in an ankle-encircling state and cord attachment means.

FIG. No. 17 is a side plan view of the preferred embodiment of the exercise apparatus being converted from an operational state to a collapsed state.

FIG. No. 18 is a side plan view of the preferred embodiment of the exercise apparatus of FIG. No. 17 in a collapsed state.

FIG. No. 19 is a side plan view of an alternative embodiment of the exercise apparatus being converted from an operational state to a collapsed state.

FIG. No. 20 is a side plan view of the preferred embodiment of the exercise apparatus with an exerciser engaging in a first exercise with the riser-engaging end of the carriage assembly attached to the riser assembly in inferior relation to the attached appendage exercise assembly.

FIG. No. 21 is a side plan view of the preferred embodiment of the exercise apparatus with an exerciser engaging in a second exercise with the riser-engaging end of the carriage assembly attached to the riser assembly in superior relation to the attached appendage exercise assembly.

FIG. No. 22 is a side plan view of the preferred embodiment of the exercise apparatus with an exerciser engaging in a third exercise with the riser-engaging end of the carriage assembly attached to the riser assembly in superior relation to the attached appendage exercise assembly.

FIG. No. 23 is a side plan view of the preferred embodiment of the exercise apparatus with an exerciser engaging in a fourth exercise with the riser-engaging end of the carriage assembly attached to the riser assembly in inferior relation to the attached appendage exercise assembly.

FIG. No. 24 is a side plan view of the preferred embodiment of the exercise apparatus with an exerciser engaging in a fifth exercise with the riser-engaging end of the carriage assembly attached to the riser assembly in superior relation to the attached appendage exercise assembly with hand-engaging grips and the foot platform assembly in engaged inferior position.

FIG. No. 25 is a side plan view of the preferred embodiment of the exercise apparatus with an exerciser engaging in a sixth exercise with the riser-engaging end of the carriage assembly attached to the riser assembly in superior relation to the attached appendage exercise assembly with ankle-encircling harnesses and the foot platform assembly in engaged inferior position.

DETAILED DESCRIPTION OF THE PREFERRED EMBODIMENT

Referring now to the drawings, the preferred embodiment of the present invention concerns an exercise apparatus as generally and perspectively illustrated in FIG. No. 1. The preferred embodiment of the present invention provides a low cost, easily operable exercise apparatus, which occupies a minimum amount of space when in use, as is generally illustrated in FIG. Nos. 20–25, inclusive. As will be seen from a review of FIG. Nos. 20–25, the preferred embodiment of the present invention enables a user 250 to exercise or isotonically train a wide variety of muscle groups by exerting muscular effort against varying degrees of the user's own body weight resistance to achieve some level of physical activity or as part of an otherwise regular exercise regimen. As is outlined in Table No. 1, the present invention enables user 250 to exercise at varying levels of body weight resistance. Using a 200-pound load for descriptive purposes, Table No. 1 outlines 17 positions, which effectively provide 17 angles of elevation with respect to the horizontal with which user 250 may exercise.

TABLE NO. 1

| POSITION NO. | ANGLE (DEGREES) | PERCENTAGE (%) RESISTANCE | RESISTANCE (LBS) 200-POUND LOAD |
|---|---|---|---|
| 1 | 0 | 0 | |
| 2 | 2 | 3.5 | 6.9 |
| 3 | 5.2 | 9.1 | 18.1 |
| 4 | 8 | 13.9 | 27.8 |
| 5 | 10.5 | 18.2 | 36.4 |
| 6 | 13.2 | 22.8 | 45.6 |
| 7 | 16 | 27.6 | 55.1 |
| 8 | 19 | 32.6 | 65.1 |
| 9 | 22 | 37.5 | 74.9 |
| 10 | 25 | 42.3 | 84.5 |
| 11 | 28 | 46.9 | 93.8 |
| 12 | 31 | 51.5 | 103 |
| 13 | 34.5 | 56.6 | 113.2 |
| 14 | 38 | 61.6 | 123.1 |
| 15 | 42 | 66.9 | 133.8 |
| 16 | 46 | 71.9 | 143.8 |
| 17 | 50 | 76.6 | 153.2 |

Citing Position No. 17 as an example for illustration purposes, a 200-pound user my operate the exercise apparatus at Position No. 17, or at maximum elevation, and exert muscle force against 76.6% or 153.2 pounds of the user's body weight. As will be seen from a review and appreciation of Table No. 1, user 250 may thus exercise along a spectrum of body weight resistance levels ranging from relatively low levels of body weight resistance to relatively high levels of body weight resistance.

The preferred embodiment of the present invention enables users to isotonically train major muscle groups such as the chest, back, arm, leg, and abdominal areas of the human musculature, as well as a number of other muscle groups. Samplings of the various exercises enabled by the preferred embodiment of the present invention are illustrated in FIG. Nos. 20–25 inclusive, which figures further generally illustrate the primary components of the preferred embodiment of the present invention. It will thus be seen that the preferred embodiment of the present invention generally comprises a riser assembly 100 as specifically illustrated in FIG. Nos. 3, 17, and 20–25, a carriage assembly 200 as specifically illustrated in FIG. Nos. 3, 17 and 20–25, riser assembly support means, and a number of peripheral attachments.

Riser assembly 100 generally comprises a pair of parallel riser members 10 as illustrated in FIG. Nos. 1, 3, 4, 5, 14, and 17–25 and riser spacer means for maintaining riser members 10 in parallel relation. Specific attention is drawn to the spatial orientation of portions of riser members 10. In this regard, riser members 10 each comprise a superior riser end 11 as illustrated in FIG. Nos. 3, 4, 5, and 17–25; an inferior riser end 12 as illustrated in FIG. Nos. 2(*a*), 3, 17–25; a rear portion 13 as illustrated in FIG. Nos. 2(*a*), 3, 5, 14, 17 and 18; and a front portion 14 as illustrated in FIG. Nos. 2(*a*), 3, 4, 5, 14, 17 and 18. Further, riser members 10 are preferably vertically-oriented, having a right or 90° angle of inclination with respect to a substantially horizontal support surface 150 as illustrated in FIG. Nos. 3, 4, 11, 12, and 17–25. It should be noted that support surface 150 is preferably is preferably carpeted or has a relatively high frictional value, so as to help prevent the exercise apparatus from sliding during operation.

Riser members 10 must have some level of vertical dimension, if not strictly vertical, insofar as riser members 10 primarily provide elevated support to carriage assembly 200 when in use. To achieve a proper level of support, riser members 10 each comprise or are constructed from sturdy structural materials, having relatively lightweight properties. In this regard, each riser member 10 is preferably constructed from ¾-inch grade AB birch plywood and has a measured length dimension of 72 inches from superior riser end 11 to inferior riser end 12 and a measured depth dimension of 5½ inches from rear portion 13 to front portion 14.

The riser spacer means may be further defined by preferably comprising a plurality of flats 15 fixedly attached to rear portions 13 to maintain riser members 10 in parallel relation as illustrated in FIG. Nos. 1 and 3. Preferably, three flats 15, constructed from aluminum or similar other lightweight, sturdy material, are fixedly attached to rear portions 13 via flat head sheet metal screws to maintain riser members 10 in parallel relation, thus creating a uniformly spaced, rail-receiving track between riser members 10. Preferably, the aluminum flats each have measured dimensions of ⅛-inch by 2 inches by 11 inches. Flats 15 thus space riser members 10 from each other such that riser members 10 define the rail-receiving track, which is designed to receive various portions of carriage assembly 200 either while a user is utilizing the exercise apparatus or when a user is collapsing or folding the exercise apparatus into a collapsed state.

Riser members 10 each further comprise rail-riser means receiving structure or a plurality of equally-spaced, laterally-aligned riser-rod-receiving apertures 16 between superior riser end 11 and inferior riser end 12 as illustrated in FIG. Nos. 1, 35, 17 and 19. Preferably each riser member 10 comprises seventeen (17) riser-rod-receiving apertures 16. Riser-rod-receiving apertures 16 are laterally aligned so as to have cooperative riser aperture pairing, wherein each cooperative riser aperture pairing may be defined as comprising two mated apertures, which may cooperatively act to receive a laterally inserted elongate member. In this last regard, specific attention is drawn to a peripheral, but critical component, namely, a rail-riser rod 20 as illustrated in FIG. Nos. 1, 3, 4 and 5, which functions to selectively join carriage assembly 200 to riser assembly 100 at a user-selected cooperative riser aperture pairing.

As indicated, each riser member 10 preferably has seventeen riser rod-receiving apertures 16, thus providing riser assembly 100 with seventeen sets of cooperative riser aperture pairings. The user may thus selectively attach carriage assembly 200 to riser assembly 100 at seventeen differing levels of elevation via rail-riser rod 20, thus enabling the user to select from seventeen angles of inclination or seventeen levels of body weight resistance as comparatively shown in FIG. No. 20 versus FIG. No. 21 and FIG. No. 22 versus FIG. No. 23. Preferably, riser rod-receiving apertures 16 are substantially longitudinally-aligned as can be seen from a review of FIG. Nos. 1, 3 5, 17 and 19. Specific attention is drawn, however, to a preferred exception to this general structural specification. In this last regard, it should be noted that two sets of cooperative riser aperture pairings are offset from a general longitudinal alignment. As illustrated in FIG. Nos. 3 and 17–19, inferior most cooperative aperture pairing 18 and intermediate aperture pairing 19 are offset in an anterior or a frontal direction. In other words, each riser member 10 has an inferior most riser rod-receiving aperture 18 and an intermediate riser rod-receiving aperture 19, which are offset in a forward manner. This offset characteristic is critical to the collapsing or folding capabilities of the exercise apparatus and will be discussed in more detail below.

Carriage assembly 200 generally comprises a rail assembly 21 as illustrated in FIG. Nos. 1, 3–8, 11, 12, 17, 18, and 20–25, and a movable seat assembly 50 as illustrated in FIG. Nos. 1, 3, 4, 6, 7, 8, and 17–25. Rail assembly 21 preferably comprises a pair of parallel, angled rail members 23 as illustrated in FIG. Nos. 1, 3, 4, 5, 6, 7–9, 11 and 12, and rail spacer means for maintaining angled rail members 23 in parallel relation. Further, specific attention is drawn to the spatial orientation of the two opposite ends of rail assembly 21, namely, a riser-engaging end 24 as illustrated in FIG. Nos. 1, 4, 5 and 17–19, and a foot platform end 25 as illustrated in FIG. Nos. 1, 3, 4, 9, 11, 12 and 17–19.

Angled rail members 23 are preferably each constructed from extruded aluminum angle members having measured dimensions of ⅛-inch by 2 inches by 2 inches by 84 inches. Preferably, rail spacer means may be further defined by comprising or by being constructed from three 2×4 members, each having measured dimensions of 76½ inches by 1 11/16 inches by 1½ inches. The three 2×4 members are placed side by side such that the 1 11/16 faces are juxtaposed or gathered against one another thus effectively forming an 76½-inch by 1 11/16-inch by 4½-inch member. After being drilled or bored to receive fastening means, angled rail members 23 are preferably attached to the gathered 2×4 members via the combination of a plurality of 5-inch by ¼-inch carriage bolts and ¼-inch hex lock nuts. The 76½-inch by 1 11/16-inch by 4½-inch 2×4 rail spacer means is further preferably outfitted with a plastic haircell-type laminate having measured dimensions of ⅛-inch by 4½ inches by 156½ inches. The laminate thus provides a more visually appealing protective cover to the rail spacer means.

Riser-engaging end 24 has rail-riser means or preferably has one pair of laterally-aligned rail-rod-receiving apertures 28 as illustrated in FIG. No. 5. It will be noted that rail-rod-receiving apertures 28 have cooperative rail aperture pairing, which pairing is designed to cooperatively receive rail-riser rod 20 in the hereafter described manner for attaching carriage assembly 200 to riser assembly 100. To attach carriage assembly 200 to riser assembly 100, the user may selectively and removably insert rail-riser rod 20 laterally through user-selected cooperative riser aperture pairing and the rail aperture pairing, thus removably attaching carriage assembly 200 to riser assembly 100. It will thus be seen that by selectively and removably attaching carriage assembly 200 to riser assembly 100 via riser-engaging end 24, the rail-receiving track receives riser-engaging end 24, which end may be raised or lowered at the user's election for increasing or decreasing the level of body weight resistance with which the user elects to exercise.

Preferably, rail-riser rod 20 comprises an insertion end 29 and a hand-grip end 30 as illustrated in FIG. Nos. 4 and 5. Rail-riser rod 20 is preferably constructed from conduit, having measured dimensions of 0.705-inch by 17 inches. Hand-grip end 30 is preferably outfitted with foam hand-grip material having measured dimensions of 0.705-inch by 5 inches by 0.125-inch for enabling easy manual insertion or removal of insertion end 29. The foam material of hand-grip end 30 further serves as a rod guide. In this regard, when rail-riser rod 20 is inserted laterally through user-selected cooperative riser aperture pairing and the rail aperture pairing as described, the foam material of hand-grip end 30 prevents hand-grip end 30 from sliding through the riser rod-receiving aperture 28, which first received insertion end 29 during insertion.

Insertion end 29 is preferably tapered or beveled at the tip for easier insertion purposes. Further, insertion end 29 preferably has a laterally-aligned bore hole for receiving a locking pin 31 or, preferably, a spring-loaded clevis pin with ball, with measured dimensions of ¼-inch by 1-inch grip, as illustrated in FIG. No. 5. Locking pin 31, when inserted through the bore hole, prevents insertion end 29 from being removed from user-selected cooperative riser aperture pairing and the rail aperture pairing accidentally. The user thus must remove locking pin 31 from the bore hole before removing rail-riser rod 20 from a first user-selected cooperative riser aperture pairing and the rail aperture pairing and further may reinsert locking pin 31 through the bore hole after realigning riser-engaging end 24 in the rail-receiving track at a different elevation, and inserting rail-riser rod 20 through a second user-selected cooperative riser aperture pairing and the rail aperture pairing. As earlier described, riser-engaging end 24 may thus be raised or lowered at the user's election for increasing or decreasing the level of body weight resistance with which the user elects to exercise.

Angled rail members 23 each have a guide wheel portion 26 and a runner wheel portion 27 as illustrated in FIG. Nos. 1, 5, 6 and 9. Angled rail members 23 each preferably comprise a plurality of laterally-aligned exercise bar-receiving apertures 32 between riser-engaging end 24 and foot platform end 25 as illustrated in FIG. Nos. 3, 5, 6, 22 and 23. In this regard, a first set of exercise bar-receiving apertures 32 are preferably on center and 6 inches from riser-engaging end 24; a second set of exercise bar-receiving apertures 32 are preferably on center and 15¾ inches from riser-engaging end 24; a third set of exercise bar-receiving apertures 32 (or intermediate aperture pairing 19) are preferably on center and 45 inches from riser-engaging end 24; and a fourth set of exercise bar-receiving apertures 32 are preferably on center and 80 inches from riser-engaging end 24. Exercise bar-receiving apertures 32 have cooperative bar aperture pairing, which bar aperture pairing is designed for cooperatively receiving a peripheral exercise bar 33 as further illustrated in FIG. Nos. 1, 4, 21, 22 and 23. Exercise bar 33 preferably comprises a tubing member having ⅞-inch outer diameter and measuring 36 inches in length and may be selectively and removably inserted laterally through user-selected cooperative bar aperture pairing for enabling appendage-engaged exercise.

Foot platform end 25 is preferably further defined by comprising a seat assembly railhead to prevent seat assembly 50 from rolling off of rail assembly 21. The seat assembly railhead preferably comprises an end plate 34 as illustrated in FIG. Nos. 4, 9, 11 and 12, and a foot peg 35 as illustrated in FIG. Nos. 1, 3, 4, 9, 11, 12 and 18. End plate 34 is preferably constructed of ½-inch by 2-inch by 4½-inch aluminum plate and is laterally attached intermediate angled rail members 23 as illustrated in FIG. Nos. 1, 4, 9, 11 and 12 via 4 flathead screws. Foot peg 35 is preferably constructed of ⅝-inch outer diameter steel rod having measured length dimension of 13¼ inches. Foot peg 35 is further preferably attached to the superior side of end plate 34 via a plurality of flathead screws. The seat assembly railhead thus provides mechanical stop structure to the carriage assembly for preventing seat assembly 50 from rolling off rail assembly 21. Further, the seat assembly railhead provides plantar foot support for users when in a prone position on seat assembly 50 to enable bodily exercise while in a prone position atop seat assembly 50.

Foot platform end 25 further preferably comprises a foot platform receiving sleeve 36 as illustrated in FIG. Nos. 9, 11 and 12. Foot platform receiving sleeve 36 is preferably constructed by installing two (2) spaced aluminum plates 37, each having measured dimensions of ½-inch by 2 inches by 4½ inches, which aluminum plates 37 are securely fastened to angled rail members 23 as illustrated in FIG. Nos. 1, 4, 9, 11 and 12 via the combination of four plate-penetrating, ¼-inch by 5-inch carriage bolts (two bolts per plate) and four ¼-inch hex lock nuts. These carriage bolt and hex lock nut combinations are preferred to flathead screws so as to add further strength to foot platform receiving sleeve 36.

Foot platform end 25 is further defined by preferably comprising roller means for movement. In this regard, it is contemplated that an axle member constructed of ⅝-inch outer diameter steel rod having a measured length dimension of 13¼ inches is fixedly attached to the inferior side of end plate 34 and runner wheel portions 27 as generally illustrated in FIG. Nos. 1, 3, 4, 9, 11, 12 and 17–25 via a plurality of flathead screws. Rollers 38 having 1½ inch outer diameter by 2½ inches long are then fed onto the axle member and secured thereto via star retaining rings. Rollers 38 are illustrated in FIG. Nos. 1, 3, 4, 9, 11, 12 and 17–25.

As indicated, foot platform end 25 preferably comprises a foot platform receiving sleeve 36. Foot platform receiving sleeve 36 is designed to receive a reversible foot platform assembly 40 as illustrated in FIG. Nos. 1, 3, 4, 9, 10, 11, 12, 24 and 25. Foot platform assembly 40 preferably comprises a foot platform 41, which foot platform 41 is preferably constructed from 11-inch by 18-inch marine board. Two pieces of ¾-inch square, 14 gauge tubular steel, each having measured length dimensions of 11⅝ inches, are fixedly attached to the underside or inferior side of the marine board or foot platform 41 via the combination of a series of flathead screws and locking nuts (at least two of each per length of tubular steel). The tubular steel members are preferably attached to foot platform 41 in a V-shaped pattern as shown in FIG. No. 10. By orienting and fixedly attaching the tubular steel members in this fashion and attaching the same to foot platform 41, it is contemplated that a V-shaped foot platform flange 42 is created for reversible insertion into foot platform receiving sleeve 36. Preferably, a third piece of ¾-inch square, 14 gauge tubular steel having measured length dimension of 16 inches is fixedly attached to foot platform 41 via the combination of at least two flathead screws and two locking nuts to the inferior side of foot platform 40 opposite the open end of the V-shaped tubular steel members as further illustrated in FIG. No. 10. Excellent results have been obtained by thus constructing foot platform assembly 40. The supporting tubular steel members in combination with each other provide more than adequate support structure to foot platform 41, with foot platform 41 being able to withstand at least 250 pounds with no appreciable wear and tear or compromise in the overall structure of foot platform assembly 40. As a means to promote safety and a visually appealing foot platform assembly, six square plugs may be inserted into the otherwise open ends of the tubular steel members. As illustrated in FIG. No. 9, a 2-inch spring-loaded, clevis pin or similar other platform locking pin 43 preferably locks foot platform assembly 40 in place as illustrated in FIG. Nos. 11 and 12. Once foot platform receiving sleeve 36 accepts foot platform flange 42, platform locking pin 43 may be inserted in a gap adjacent the closed end of the V-shaped foot platform flange 42. In this regard, plates 37 each further comprises locking pin-receiving apertures as are generally illustrated in FIG. No. 9.

Foot platform assembly 40 thus may be reversibly inserted into foot platform receiving sleeve 36, which is laterally disposed intermediate angled rail members 23. Thus, the reversibly insertable foot platform 41 may support a user's body weight when in an engaged superior position as illustrated in FIG. No. 11, which is readily achieved by inserting foot platform flange 42 into foot platform-receiving sleeve 36 from a superior spatial location. Reversibly insertable foot platform 41 may thus further support foot platform end 25 in an elevated state when in an engaged inferior position as is illustrated in FIG. Nos. 12, 24 and 25, which is readily achieved by inserting foot platform flange 42 into foot platform-receiving sleeve 36 from an inferior spatial location.

Seat assembly 50 generally comprises a body support platform 51 and roller means for movement as illustrated in FIG. Nos. 6–8. Body support platform 51 has a body contact upper portion 52 and a rail-engaging lower portion 53. Preferably, seat assembly 50 is constructed from ¾-inch by 9-inch pine planking, having a measured length dimension of 48 inches. Foam padding having measured dimensions of ¾-inch by 48 inches by 9 inches is applied to the superior side of the pine planking, which padding is then encased in a vinyl covering having measured dimensions of approximately 14 inches by 54½ inches. By thus manufacturing the superior side of the pine planking, body contact upper portion 52 is assembled for receiving a person's body.

Rail-engaging lower portion 53 comprises a pair of laterally-spaced roller means attachment portions 54 and a hover portion 55 intermediate laterally-spaced roller means attachment portions 54 as illustrated in FIG. Nos. 7 and 8. Laterally-spaced roller means attachment portions 54 each comprise a plurality of runner wheels 57 as illustrated in FIG. Nos. 1, 3, 6 and 7, and a plurality of guide wheels 56 as illustrated in FIG. Nos. 3, 6 and 8. Runner wheels 57 are spatially located for operative engagement with runner wheel portions 27 and guide wheels 56 are spatially located for operative engagement with guide wheel portions 26. Rail-engaging lower portion 53 preferably comprises six runner wheels 57 (three on each side of seat assembly 50) and four guide wheels 56 (two on each side of seat assembly 50). FIG. No. 3 illustrates a view of the left-hand runner wheels 57 and guide wheels 56. Runner wheels 57 preferably comprise 2-inch plastic casters mounted to laterally-spaced roller means attachment portions 54 via a series of No. 10 by ⅝ inch trus screws (4 per caster). Guide wheels 56 preferably comprise No. 6×1⅝-inch sliding door type rollers and are mounted to laterally-spaced roller means attachment portions 54 via 2-inch deck screws. Preferably, ½-inch by 13/16-inch tubing spacers are fed onto the deck screws to properly space guide wheels 56 in inferior spatial relation to laterally-spaced roller means attachment portions 54.

The riser assembly support means or riser support assembly or riser member support means is preferably further defined by comprising a rear support assembly, a front support assembly and lateral support means. The rear support assembly preferably comprises a pair of rear stabilizer members 60 as illustrated in FIG. Nos. 1, 3, 17 and 20–25, and a pair of rear stabilizer rods 61 as also illustrated in FIG. Nos. 1, 3, 17 and 20–25. Rear stabilizer members 60 each preferably comprise aluminum angle members having measured dimensions of ⅛-inch by 1½ inches by 1½ inches by 25 inches. Rear stabilizer members 60 each have an anterior rear end 62 and a posterior rear end 63 as illustrated in FIG. Nos. 3, 17 and 18. Anterior rear ends 62 are each pivotally attached to rear portions 13 of riser members 10, preferably via the cooperative combination of ¼-inch-20 by 1¼-inch hex bolts, ¼-inch-20 hex nuts, ¼-inch washer fastening structures (one bolt, one nut, one bolt head washer, and one nut washer per anterior rear end 62). Rear stabilizer rods 61 each have a rear stabilizer member attachment end 64 and a rear riser member attachment end 65 as illustrated in FIG. Nos. 3, 17 and 18, and are preferably constructed from 0.705-inch by 48-inch conduit. Rear stabilizer member attachment ends 64 are pivotally attached to rear stabilizer members 60 adjacent posterior rear ends 63, preferably via the cooperative combination of ¼-inch-20 by 1-inch flat head machine screws and ¼-inch lock nuts (one screw and one nut per rear stabilizer member attachment end 64). Rear riser member attachment ends 64 are designed for releasable fastening attachment to riser members 10, for enabling users to orient rear stabilizer members 60 at right angles or 90° to riser members 10 for providing rearward support to riser assembly 100. To achieve this function, rear riser member attachment ends 65 each preferably comprise a lateral bore hole for receiving a ¼-inch-20 by 1-inch wing/thumb screw, which screw is inserted through each lateral bore hole and is threadably inserted into a ¼-inch-20 by 13 mm insert nut, which insert nut is preset or pre-embedded in each riser member 10 at the specified posterior attachment point for receiving the wing/thumb screw. Additionally, a ⅛-inch by 2-inch by 11-inch aluminum flat is preferably affixed to rear stabilizer members 60 adjacent posterior ends 63 to further stabilize the posterior most portion of the rear support assembly as generally illustrated in FIG. No. 1. The cooperative combination of No. 6 by ⅜-inch flat head machine screws and No. 6 by ⅜-inch hex nuts with lock washers (two screws and two nuts per attachment point) fixedly attach the aluminum flat to rear stabilizer members 60. As a means to promote safety and a visually appealing foot platform assembly, ⅝-inch caps or plugs may be inserted into the otherwise open ends of rear stabilizer rods 61.

The front support assembly preferably comprises a pair of front stabilizer members 70 and a pair of front stabilizer rods 71 as illustrated in FIG. Nos. 1, 3, 17, 18 and 20–25. Front stabilizer members 70 each preferably comprise aluminum angle members having measured dimensions of ⅛-inch by 1½ inches by 1½ inches by 42 inches. Front stabilizer members 70 each have an anterior front end 72 and a posterior front end 73 as illustrated in FIG. Nos. 3, 17 and 18. Posterior front ends 73 are each pivotally attached to front portions 14 of riser members 10, preferably via the cooperative combination of ¼-inch-20 by 1¼-inch hex bolts, ¼-inch-20 hex nuts, ¼-inch washer fastening structures (one bolt, one nut, one bolt head washer, and one nut washer per posterior front end 73). Front stabilizer rods 71 each have a front stabilizer member attachment end 74 and a front riser member attachment end 75 as illustrated in FIG. Nos. 3, 17 and 18, and are preferably constructed from 0705-inch by 30-inch conduit. Front stabilizer member attachment ends 74 are pivotally attached to front stabilizer members 70 adjacent anterior front ends 72, preferably via the cooperative combination of ¼-inch-20 by 1-inch flat head machine screws and ¼-inch lock nuts (one screw and one nut per front stabilizer member attachment end 70). Front riser member attachment ends 75 are designed for releasable fastening attachment to riser members 10, for enabling users to orient front stabilizer members 70 at right angles or 90° to riser members 10 for providing frontal support to riser assembly 100. To achieve this function, front riser member attachment ends 75 each preferably comprise a lateral bore hole for receiving a ¼-inch-20 by 1-inch wing/thumb screw, which screw is inserted through each lateral bore hole and is threadably inserted into a ¼-inch-20 by 13 mm insert nut, which insert nut is preset or pre-embedded in each riser member 10 at the specified anterior attachment point for receiving the wing/thumb screw. Additionally, a ⅛-inch by 2-inch by 11-inch aluminum flat is preferably affixed to front stabilizer members 70 adjacent anterior ends 72 to further stabilize the anterior most portion of the front support assembly. The cooperative combination of No. 6 by ⅜-inch flat head machine screws and No. 6 by ⅜-inch hex nuts with lock washers (two screws and two nuts per attachment point) fixedly attach the aluminum flat to front stabilizer members 70. As a means to promote safety and a visually appealing foot platform assembly, ⅝-inch caps or plugs may be inserted into the otherwise open ends of front stabilizer rods 71.

The lateral support means may be described by preferably comprising a lateral support member 80 as illustrated in FIG. Nos. 1, 2(*a*), 3, 4 and 20–25. Lateral support member 80 is preferably constructed from ¾-inch grade AB birch plywood having approximate measured dimensions of 5½-inches by 38⅞-inches. As can be seen from an inspection of FIG. Nos. 1 and 3, the top edge of lateral support member 80 may be tapered or slanted to the lateral most ends to achieve a more visually appealing lateral support means. Preferably, lateral support member 80 is notched on the inferior edge (not shown) to receive the upright portions of rear stabilizer members 60 and is placed in posterior adjacency to inferior end 12 as shown. Lateral support member 80 is thus removably attached or affixed to inferior end 12 adjacent posterior portion 13 to provide lateral support to riser assembly 100. Preferably, one ⅛-inch by 2-inch by 2-inch angled bracket 81 is fixedly attached to the inferior end of each riser member 10 as partially illustrated in FIG. No. 2(*a*) via fastening screws. To achieve this function, ¼-inch-20 by ½-inch wing/thumb screws are fed through preferably oval apertures in the angled bracket members, which wing/thumb screws are threadably inserted into a ¼-inch-20 by 13 mm insert nut 82, which insert nut 82 is preset or pre-embedded in lateral support member 80 as shown in FIG. No. 2(*a*) and 2(*b*) for receiving the respective wing/thumb screw. The user may thus easily remove and reattach lateral support member 80 to riser assembly 100 as needed for proving added lateral support to riser assembly 100.

Riser assembly 100 preferably further comprises a peripheral appendage exercise assembly 90 as generally illustrated in FIG. No. 13 for enabling various appendage-dependent exercises as illustrated in FIG. Nos. 20, 24 and 25. Appendage exercise assembly 90 comprises a cord-riser rod 91 as illustrated in FIG. Nos. 1, 3, 4, 13, 14, 20–22, 24 and 25, and a pair of cord assemblies 92 as illustrated in FIG. Nos. 1, 3, 4, 13, 20–22, 24 and 25. Cord-riser rod 91 is preferably constructed from 0.705-inch conduit having a measured length dimension of 13½-inches. Each end of cord-riser rod 91 comprises a lateral bore hole for receiving cord-riser rod attachment means. By removing cord-riser rod attachment means from one end, the user may selectively insert cord-riser rod 91 laterally through appendage exercise assembly attachment means or user-selected cooperative riser aperture pairing as shown and then reattach the cord-riser rod attachment means to prevent cord-riser rod 91 from accidentally being pulled from its operative placement. Further, the ends of cord-riser rod 91 are preferably tapered or beveled at the respective tips for easier insertion purposes. Cord-riser rod has laterally-aligned cord assembly attachment ends, which extend laterally from riser members 10 when selectively inserted therethrough as generally shown in FIG. Nos. 1, 4 and 13. Cord assemblies 92 each have connector means or preferably comprise cord-riser rod attachment means, a length of cord, and an appendage-engaging assembly. Cord-riser rod attachment means preferably comprise 3⁄16-inch spring link couplings 94 as illustrated in FIG. Nos. 13 and 14. The appendage-engaging assemblies each further comprise an appendage-engaging portion 93 as comparatively illustrated in FIG. No. 13 and FIG. Nos. 15(*a*), 15(*b*) and 16; and cord attachment means. Cord attachment means also preferably comprise 3⁄16-inch spring link couplings 94 as illustrated in FIG. Nos. 13 and 16.

The appendage-engaging portions may either comprise a hand-engaging grip 95 as illustrated in FIG. Nos. 1, 3, 4, 13, 13, 20 and 24, or an ankle-encircling harness 96 as illustrated in FIG. Nos. 15(*a*), 15(*b*), 16, 25. Depending on the exercise the user may wish to practice, either hand-engaging grip 95 or ankle-encircling harness 96 may be attached to the length of cord. Each hand-engaging grip 95 preferably comprises a 20-inch 7×19 type ⅛-inch cable, having 3⁄16 coated diameter, fed through a 0.705-inch conduit having a measured length dimension of 6 inches, which conduit is preferably coated with foam grip material. Each ankle-encircling harness 96 preferably comprises a 2-inch piece of webbing material sized and shaped as shown to sufficiently encircle a user's ankle, which webbing material is further preferably outfitted with 2-inch wide VELCRO brand hook and loop fastening materials. Each ankle-encircling harness 96 further comprises a D-ring for attachment to the cord lengths via cord attachment means.

It is further contemplated that at least two sets of cord lengths may be utilized depending on the exercise the user may wish to practice as is generally illustrated in FIG. No. 13. Preferably, the cords each comprise 7×19 type ⅛-inch cable, having 3⁄16 coated diameter. The measured length dimension for each of the longer cord lengths is 29½ inches with eye-type couplings attached at each end. The measured length dimension for each of the shorter cord lengths is 10 inches with eye-type couplings attached.

Further, the preferred embodiment of the present invention importantly provides a foldable or collapsible exercise apparatus to enable easier shipment of the product or to enable easier horizontal transferability, for example, when storing the product. The preferred embodiment of the present invention is foldable or collapsible, such that the entire carriage assembly and all peripheral attachments may be housed or nestedly received in the carriage assembly-receiving track, thus providing for a compact, nested arrangement for shipment or storage as is generally illustrated in FIG. Nos. 17 and 18. Further the riser assembly support means may be folded or collapsed to rest in snug adjacency to the riser assembly for easy shipment or storage as further shown in FIG. Nos. 17 and 18.

The preferred method of collapsing the preferred embodiment of the present invention is achieved by removing rail-riser rod 20 from user-selected cooperative riser aperture pairing and the rail aperture pairing, thus detaching carriage assembly 200 from riser assembly 100. Carriage assembly 200 is then reattached to riser assembly 100 at the inferior most set of riser rod-receiving apertures or at inferior most cooperative aperture pairing 18, which corresponds to Position No. 1 as reflected in Table No. 1 and as referenced in FIG. Nos. 3, 17 and 18. The lateral support means or lateral support member 80 is then removed from inferior end 12. The front riser member attachment ends 75 are then unfastened from the anterior portion of riser members 10 and front riser support rods 71 are rotated or pivoted in a forward manner as is generally shown in FIG. No. 17. Riser assembly 100 with the rear support assembly in attached assembly is then pivoted about a pivot point indicated at 18 as shown in FIG. No. 17, in a forward manner to a substantially horizontal position or until front portions 14 of riser members 10 rest atop the flat portions of front stabilizer members 70. Front riser member attachment ends 75 are then removably attached to front portion 14 of each riser member 10. Front portion 14 of each riser member 10 preferably has a collapsed attachment aperture 97 as illustrated in FIG. No. 17. One 0.200×0.140 grip rivet nut or T-nut is then laterally inserted from a medial location through each collapsed attachment aperture 97. Front riser member attachment ends 75 are then attached to riser members 10 via ¼-inch-20 by 1-inch wing/thumb screws, which screws are threaded into the inserted rivet nuts or T-nuts.

Rear riser member attachment ends 65 are then unfastened from riser members 10 and rear stabilizer members 60 and rear stabilizer rods 61 are pivoted in a forward manner to a substantially horizontal position or until the horizontal or ground-engaging portions of rear stabilizer members 60 rest atop rear portions 13 of riser members 10, as is further shown in mid-pivot in FIG. No. 17. Rear riser member attachment ends 65 are then removably attached to rear portions 13 of riser members 10. Rear portions 13 of riser members 10 each also preferably have a collapsed attachment aperture 97 as illustrated in FIG. Nos. 17 and 18. One 0.200×0.140 grip rivet nut or T-nut is then laterally inserted from a medial location through each collapsed attachment aperture 97. Rear riser member attachment ends 65 are then attached to riser members 10 via ¼-inch-20 by 1-inch wing/thumb screws, which screws are threaded into the inserted rivet nuts or T-nuts. Carriage assembly 200 is thus nestedly received or housed within the carriage assembly-receiving track for easy horizontal transferability, whether for shipment purposes or for storage purposes. At the user's option and during shipping, appendage exercise assembly 90, exercise bar 33, and other peripherals, as described, may also be nestedly received or housed within the carriage assembly-receiving track before riser assembly 100 is pivoted forward as described.

ALTERNATIVE EMBODIMENT

An alternative embodiment of the present invention concerns an exercise apparatus for mounting to a wall. The alternative embodiment of the present invention is virtually identical to the preferred embodiment of the present invention save for the riser assembly support means, which essentially comprises wall means for support, whereby flats 15 each have means for wall attachment or wall stud attachment. It is contemplated, as is illustrated in FIG. No. 19, that flats 15 may be constructed from thicker materials to provide more appropriate wall spacer means as is generally illustrated in FIG. No. 19. Often, baseboards are found along the basal perimeter of rooms, and thus wall spacer means or the described, modified versions of flats 15 may be necessary.

Further, the alternative embodiment of the present invention importantly provides a foldable or collapsible exercise apparatus to enable easier vertical storage of the product when not is exercisable use as is shown in FIG. No. 19. The alternative embodiment of the present invention is foldable or collapsible, such that the entire carriage assembly and all peripheral attachments may be housed or nestedly received in the carriage assembly-receiving track, thus providing for a compact, nested arrangement for vertical storage.

The preferred method of collapsing the alternative embodiment of the present invention is achieved by removing rail-riser rod 20 from user-selected cooperative riser aperture pairing and the rail aperture pairing, thus detaching carriage assembly 200 from riser assembly 100. Carriage assembly 200 is then reattached to riser assembly 100 at inferior most cooperative aperture pairing 18, or at Position No. 1 as reflected in Table No. 1 and as indicated in FIG. No. 19 at 18. Seat assembly 50 is then moved toward riser members 10 and foot platform end 25 is raised or pivoted to a substantially vertical position, being pivoted about the pivot point located at inferior most cooperative aperture pairing 18 as is demonstrated in FIG. No. 19. Once in a substantially vertical orientation, cable-riser rod 91 may be inserted through intermediate aperture pairing 19 and through an intermediate rail aperture pairing or an intermediate exercise bar-receiving apertures 32 as illustrated in FIG. No. 19, thus locking carriage assembly 200 in a vertical position in nested relation to riser assembly within the carriage assembly-receiving track. At the user's option, exercise bar 33 and other peripherals, as described, may be nestedly received or housed within the carriage assembly-receiving track before carriage assembly 200 is pivoted upward as described.

It will thus be seen that the present invention provides an exercise apparatus, made from low cost materials. Further, the present invention is easy to operate and requires a minimal amount of free space to operate in a given exercise setting. Further, the present invention provides an exercise apparatus comprising a multi-purpose riser assembly, which primarily provides variable vertical support to carriage assembly 200 when in an operational state and primarily provides a sturdy structural housing for carriage assembly 200 and all peripheral attachments when in a collapsed state to enable easier shipment and/or storage of the present invention. Further, the present invention provides an exercise apparatus, which may be assembled from a nested or shipped state without the use of tools and which exercise apparatus may then be further collapsed back into a nested or shipping-like state without the use tools.

Further, the present invention provides an exercise apparatus, which comprises a parallel riser member assemblage, which assemblage provides attachment means for attaching further exercise-enabling structure, which attachment means is vertically variable at the user's election, and which exercise-enabling structure operates independent of cord/pulley means. Still further, the preferred embodiment of the present invention provides an exercise apparatus comprising riser member support means, which riser member support means may collapse such that the riser member support means rest in immediate adjacency to the riser members or in nested relation to the riser members for enabling more convenient shipment or storage. Further still, the present invention provides an exercise apparatus comprising a riser member assemblage, which defines a carriage assembly-receiving track and which further comprises a plurality of cooperative riser aperture pairings for selectively elevating a riser member attachment end of carriage assembly 200 via riser rod 20. Still further, the present invention provides an exercise apparatus comprising a carriage assembly, which, in turn, comprises a plurality of cooperative bar aperture pairings, which enable users to exercise varying muscle groups via removably insertable exercise bar 33. Additionally, the present invention provides an exercise apparatus comprising a dual-purpose, reversible foot platform, which foot platform attaches to foot platform end 25 of rail assembly 21 for supporting a user's body weight when in an engaged superior position or for supporting foot platform end 25 in an elevated state when in an engaged inferior position.

While the above description contains much specificity, this specificity should not be construed as limitations on the scope of the invention, but rather as an exemplification of the invention. For example, foot platform assembly 40 need not comprise V-shaped foot platform flange 42. So long as the foot platform assembly attaches to foot platform end 25 of rail assembly 21 for supporting a user's body weight when in an engaged superior position or for supporting an elevated foot platform end 25 when in an engaged inferior position, foot platform assembly 40 successfully fulfills its dual support or reversible support purpose.

Furthermore, each riser member 10 need not comprise 17 riser rod-receiving apertures 16. So long as riser assembly 100 primarily provides variable vertical support to carriage assembly 200 when in an operational state and primarily provides a sturdy structural housing for carriage assembly 200 and all peripheral components when in a collapsed state to enable easier shipment and/or storage of the present invention, riser members 10, as the key components of riser assembly 100, successfully fulfill the described multi-purpose.

Accordingly, although the invention has been described by reference to a preferred embodiment and an alternative embodiment, it is not intended that the novel device be limited thereby, but that modifications thereof are intended to be included as falling within the broad scope and spirit of the foregoing disclosure, the following claims and the appended drawings.

I claim:

1. An exercise apparatus for enabling exercise by way of selective levels of body weight resistance, the exercise apparatus comprising:

a rail-riser rod;

an exercise bar;

a riser assembly, the riser assembly comprising a pair of parallel, vertical riser members, riser spacer means for maintaining the riser members in parallel relation, and an appendage exercise assembly, the riser spacer means thus creating a rail-receiving track between the riser members, the riser members each having a superior riser end, an inferior riser end, and a plurality of equally-spaced, laterally-aligned riser-rod-receiving apertures between the superior riser end and the inferior riser end, each inferior riser end having a rear portion and a front portion, the riser-rod-receiving apertures having cooperative riser aperture pairing, the riser aperture pairing for cooperatively receiving the rail-riser rod, the appendage exercise assembly comprising a cord-riser rod and a pair of cord assemblies, the cord-riser rod being selectively inserted laterally through a first user-selected cooperative riser aperture pairing, the cord-riser rod having laterally-aligned cord assembly attachment ends, the cord assembly attachment ends extending laterally from the riser members when selectively inserted therethrough, the cord assemblies each comprising cord-riser rod attachment means, a length of cord, and an appendage-engaging assembly, the appendage-engaging assemblies each further comprising an appendage-engaging portion and cord attachment means, the lengths of cord each having a cord-riser rod attachment end and an appendage-engaging assembly attachment end, the cord-riser rod attachment means removably attaching the cord-riser rod attachment ends to the cord assembly attachment ends, the cord attachment means attaching the appendage-engaging portions to the appendage-engaging assembly attachment ends for enabling exercise;

a carriage assembly, the carriage assembly comprising a rail assembly and a seat assembly, the rail assembly comprising a pair of parallel, angled rail members, rail spacer means for maintaining the rail members in parallel relation, a riser-engaging end and a foot platform end, the angled rail members each having a guide wheel portion, a runner wheel portion, and a plurality of spaced, laterally-aligned exercise bar-receiving apertures between the riser-engaging end and the foot platform end, the exercise bar-receiving apertures having cooperative bar aperture pairing, the bar aperture pairing for cooperatively receiving the exercise bar, the exercise bar being selectively and removably inserted laterally through user-selected cooperative bar aperture pairing for further enabling exercise, the riser-engaging end having a pair of laterally-aligned rail-rod-receiving apertures, the rail-rod-receiving apertures having cooperative rail aperture pairing, the rail aperture pairing for cooperatively receiving the rail-riser rod, the riser-engaging end being received in the rail-receiving track, the rail-riser rod being selectively and removably inserted laterally through a second user-selected cooperative riser aperture pairing and the rail aperture pairing, thus removably attaching the carriage assembly to the riser assembly, the seat assembly comprising a body support platform and roller means for movement, the body support platform having a body contact upper portion and a rail-engaging lower portion, the rail-engaging lower portion having a pair of laterally-spaced roller means attachment portions and a hover portion intermediate the laterally-spaced roller means attachment portions, the laterally-spaced roller means attachment portions each having a plurality of runner wheels and a plurality of guide wheels, the runner wheels being spatially located for operative engagement with the runner wheel portions, the guide wheels being spatially located for operative engagement with the guide wheel portions; and a riser support assembly, the riser support assembly comprising a rear support assembly, a front support assembly and lateral support means, the rear support assembly comprising a pair of rear stabilizer members and a pair of rear stabilizer rods, the rear stabilizer members each having an anterior rear end and a posterior rear end, the anterior rear ends being pivotally attached to the rear portions, the rear stabilizer rods each having a rear stabilizer member attachment end and a rear riser member attachment end, the rear stabilizer member attachment ends being pivotally attached to the rear stabilizer members, the rear riser member attachment ends for releasable fastening attachment to the riser members, thus enabling users to orient the rear stabilizer members at right angles to the riser members for providing rearward support to the riser assembly, the front support assembly comprising a pair of front stabilizer members and a pair of front stabilizer rods, the front stabilizer members each having an anterior front end and a posterior front end, the posterior front ends being pivotally attached to the front portions, the front stabilizer rods each having a front stabilizer member attachment end and a front riser member attachment end, the front stabilizer member attachment ends being pivotally attached to the front stabilizer members, the front riser member attachment ends for releasable fastening attachment to the riser members, thus enabling users to orient the front stabilizer members at right angles to the riser members for providing front support to the riser assembly, the lateral support means being removably affixed to the inferior end to provide lateral support to the riser assembly.

2. The exercise apparatus of claim 1 wherein the rail-riser rod is further defined by comprising an insertion end and a hand-grip end, the insertion end being selectively and removably inserted laterally through the first user-selected cooperative riser aperture pairing and the rail aperture pairing, thus removably attaching the carriage assembly to the riser assembly, the hand-grip end being outfitted with a hand-grip for enabling easy manual insertion or removal of the insertion end.

3. The exercise apparatus of claim 2 wherein the appendage exercise assembly is further defined by comprising an appendage-engaging assembly selected from the group consisting of a hand-engaging grip and an ankle-encircling harness.

4. The exercise apparatus of claim 3 wherein the foot platform end is further defined by comprising roller means for movement.

5. The exercise apparatus of claim 4 wherein the foot platform end is further defined by comprising a foot platform-receiving sleeve and a reversible foot platform assembly, the foot platform assembly comprising a foot platform and a foot platform flange, the foot platform flange for superior or inferior insertion into the foot platform-receiving sleeve, the foot platform thus providing support to a user's body weight when in an engaged superior position or providing elevated support to the foot platform end when in an engaged inferior position.

6. The exercise apparatus of claim 5 wherein the exercise apparatus is selectively collapsible, whereby the carriage assembly is nestedly received within the rail-receiving track for enabling horizontal transferability.

7. An exercise apparatus for enabling exercise by way of selective levels of body weight resistance, the exercise apparatus comprising:

a rail-riser rod;

an exercise bar;

a riser assembly, the riser assembly comprising a pair of parallel, vertical riser members and riser spacer means for maintaining the riser members in parallel relation, the riser spacer means thus creating a rail-receiving track between the riser members, the riser members each having a superior riser end, an inferior riser end, and a plurality of equally-spaced, laterally-aligned riser-rod-receiving apertures between the superior riser end and the inferior riser end, each inferior riser end having a rear portion and a front portion, the riser-rod-receiving apertures having cooperative riser aperture pairing, the riser aperture pairing for cooperatively receiving the rail-riser rod;

a carriage assembly, the carriage assembly comprising a rail assembly and a seat assembly, the rail assembly comprising a pair of parallel, angled rail members, rail spacer means for maintaining the rail members in parallel relation, a riser-engaging end and a foot platform end, the angled rail members each having a guide wheel portion, a runner wheel portion, and a plurality of spaced, laterally-aligned exercise bar-receiving apertures between the riser-engaging end and the foot platform end, the exercise bar-receiving apertures having cooperative bar aperture pairing, the bar aperture pairing for cooperatively receiving the exercise bar, the exercise bar being selectively and removably inserted laterally through user-selected cooperative bar aperture pairing for further enabling exercise, the riser-engaging end having a pair of laterally-aligned rail-rod-receiving apertures, the rail-rod-receiving apertures having cooperative rail aperture pairing, the rail aperture pairing for cooperatively receiving the rail-riser rod, the riser-engaging end being received in the rail-receiving track, the rail-riser rod being selectively and removably inserted laterally through a first user-selected cooperative riser aperture pairing and the rail aperture pairing, thus removably attaching the carriage assembly to the riser assembly, the seat assembly comprising a body support platform and roller means for movement, the body support platform having a body contact upper portion and a rail-engaging lower portion, the rail-engaging lower portion having a pair of laterally-spaced roller means attachment portions and a hover portion intermediate the laterally-spaced roller means attachment portions, the laterally-spaced roller means attachment portions each having a plurality of runner wheels and a plurality of guide wheels, the runner wheels being spatially located for operative engagement with the runner wheel portions, the guide wheels being spatially located for operative engagement with the guide wheel portions; and a riser support assembly, the riser support assembly comprising a rear support assembly, a front support assembly and lateral support means, the rear support assembly comprising a pair of rear stabilizer members and a pair of rear stabilizer rods, the rear stabilizer members each having an anterior rear end and a posterior rear end, the anterior rear ends being pivotally attached to the rear portions, the rear stabilizer rods each having a rear stabilizer member attachment end and a rear riser member attachment end, the rear stabilizer member attachment ends being pivotally attached to the rear stabilizer members, the rear riser member attachment ends for releasable fastening attachment to the riser members, thus enabling users to orient the rear stabilizer members at right angles to the riser members for providing rearward support to the riser assembly, the front support assembly comprising a pair of front stabilizer members and a pair of front stabilizer rods, the front stabilizer members each having an anterior front end and a posterior front end, the posterior front ends being pivotally attached to the front portions, the front stabilizer rods each having a front stabilizer member attachment end and a front riser member attachment end, the front stabilizer member attachment ends being pivotally attached to the front stabilizer members, the front riser member attachment ends for releasable fastening attachment to the riser members, thus enabling users to orient the front stabilizer members at right angles to the riser members for providing front support to the riser assembly, the lateral support means being removably affixed to the inferior end to provide lateral support to the riser assembly.

8. The exercise apparatus of claim 7 wherein the rail-riser rod is further defined by comprising an insertion end and a hand-grip end, the insertion end being selectively and removably inserted laterally through the first user-selected cooperative riser aperture pairing and the rail aperture pairing, thus removably attaching the carriage assembly to the riser assembly, the hand-grip end being outfitted with a hand-grip for enabling easy manual insertion or removal of the insertion end.

9. The exercise apparatus of claim 7 wherein the riser assembly further comprises an appendage exercise assembly, the appendage exercise assembly comprising a cord-riser rod and a pair of cord assemblies, the cord-riser rod being selectively inserted laterally through a second user-selected cooperative riser aperture pairing, the cord-riser rod having laterally-aligned cord assembly attachment ends, the cord assembly attachment ends extending laterally from the riser members when selectively inserted therethrough, the cord assemblies each comprising cord-riser rod attachment means, a length of cord, and an appendage-engaging assembly, the appendage-engaging assemblies each further comprising an appendage-engaging portion and cord attachment means, the lengths of cord each having a cord-riser rod attachment end and an appendage-engaging assembly attachment end, the cord-riser rod attachment means removably attaching the cord-riser rod attachment ends to the cord assembly attachment ends, the cord attachment means attaching the appendage-engaging portions to the appendage-engaging assembly attachment ends for further enabling exercise.

10. The exercise apparatus of claim 9 wherein the appendage exercise assembly is further defined by comprising an appendage-engaging assembly selected from the group consisting of a hand-engaging grip and an ankle-encircling harness.

11. The exercise apparatus of claim 10 wherein the foot platform end is further defined by comprising roller means for movement.

12. The exercise apparatus of claim 11 wherein the foot platform end is further defined by comprising a foot platform-receiving sleeve and a reversible foot platform assembly, the foot platform assembly comprising a foot platform and a foot platform flange, the foot platform flange for superior or inferior insertion into the foot platform-receiving sleeve, the foot platform thus providing support to a user's body weight when in an engaged superior position or providing elevated support to the foot platform end when in an engaged inferior position.

13. The exercise apparatus of claim 12 wherein the exercise apparatus is selectively collapsible, whereby the carriage assembly is nestedly received within the rail-receiving track for enabling horizontal transferability.

14. An exercise apparatus for enabling exercise by way of selective levels of body weight resistance, the exercise apparatus comprising:

a rail-riser rod;

a riser assembly, the riser assembly comprising a pair of parallel, vertical riser members and riser spacer means for maintaining the riser members in parallel relation, the riser spacer means thus creating a rail-receiving track between the riser members, the riser members each having a superior riser end, an inferior riser end, and a plurality of equally-spaced, laterally-aligned riser-rod-receiving apertures between the superior riser end and the inferior riser end, each inferior riser end having a rear portion and a front portion, the riser-rod-receiving apertures having cooperative riser aperture pairing, the riser aperture pairing for cooperatively receiving the rail-riser rod;

a carriage assembly, the carriage assembly comprising a rail assembly and a seat assembly, the rail assembly comprising a pair of parallel, angled rail members, rail spacer means for maintaining the rail members in parallel relation, a riser-engaging end and a foot platform end, the angled rail members each having a guide wheel portion and a runner wheel portion, the riser-engaging end having a pair of laterally-aligned rail-rod-receiving apertures, the rail-rod-receiving apertures having cooperative rail aperture pairing, the rail aperture pairing for cooperatively receiving the rail-riser rod, the riser-engaging end being received in the rail-receiving track, the rail-riser rod being selectively and removably inserted laterally through a first user-selected cooperative riser aperture pairing and the rail aperture pairing, thus removably attaching the carriage assembly to the riser assembly, the seat assembly comprising a body support platform and roller means for movement, the body support platform having a body contact upper portion and a rail-engaging lower portion, the rail-engaging lower portion having a pair of laterally-spaced roller means attachment portions and a hover portion intermediate the laterally-spaced roller means attachment portions, the laterally-spaced roller means attachment portions each having a plurality of runner wheels and a plurality of guide wheels, the runner wheels being spatially located for operative engagement with the runner wheel portions, the guide wheels being spatially located for operative engagement with the guide wheel portions; and a riser support assembly, the riser support assembly comprising a rear support assembly, a front support assembly and lateral support means, the rear support assembly comprising a pair of rear stabilizer members and a pair of rear stabilizer rods, the rear stabilizer members each having an anterior rear end and a posterior rear end, the anterior rear ends being pivotally attached to the rear portions, the rear stabilizer rods each having a rear stabilizer member attachment end and a rear riser member attachment end, the rear stabilizer member attachment ends being pivotally attached to the rear stabilizer members, the rear riser member attachment ends for releasable fastening attachment to the riser members, thus enabling users to orient the rear stabilizer members at right angles to the riser members for providing rearward support to the riser assembly, the front support assembly comprising a pair of front stabilizer members and a pair of front stabilizer rods, the front stabilizer members each having an anterior front end and a posterior front end, the posterior front ends being pivotally attached to the front portions, the front stabilizer rods each having a front stabilizer member attachment end and a front riser member attachment end, the front stabilizer member attachment ends being pivotally attached to the front stabilizer members, the front riser member attachment ends for releasable fastening attachment to the riser members, thus enabling users to orient the front stabilizer members at right angles to the riser members for providing front support to the riser assembly, the lateral support means being removably affixed to the inferior end to provide lateral support to the riser assembly.

15. The exercise apparatus of claim 14 wherein the rail-riser rod is further defined by comprising an insertion end and a hand-grip end, the insertion end being selectively and removably inserted laterally through the first user-selected cooperative riser aperture pairing and the rail aperture pairing, thus removably attaching the carriage assembly to the riser assembly, the hand-grip end being outfitted with a hand-grip for enabling easy manual insertion or removal of the insertion end.

16. The exercise apparatus of claim 14 wherein the exercise apparatus is further defined by comprising an exercise bar and the angled rail members each further comprise a plurality of spaced, laterally-aligned exercise bar-receiving apertures between the riser-engaging end and the foot platform end, the exercise bar-receiving apertures having cooperative bar aperture pairing, the bar aperture pairing for cooperatively receiving the exercise bar, the exercise bar being selectively and removably inserted laterally through user-selected cooperative bar aperture pairing for further enabling exercise.

17. The exercise apparatus of claim 14 wherein the riser assembly further comprises an appendage exercise assembly, the appendage exercise assembly comprising a cord-riser rod and a pair of cord assemblies, the cord-riser rod being selectively inserted laterally through a second user-selected cooperative riser aperture pairing, the cord-riser rod having laterally-aligned cord assembly attachment ends, the cord assembly attachment ends extending laterally from the riser members when selectively inserted therethrough, the cord assemblies each comprising cord-riser rod attachment means, a length of cord, and an appendage-engaging assembly, the appendage-engaging assemblies each further comprising an appendage-engaging portion and cord attachment means, the lengths of cord each having a cord-riser rod attachment end and an appendage-engaging assembly attachment end, the cord-riser rod attachment means removably attaching the cord-riser rod attachment ends to the cord assembly attachment ends, the cord attachment means attaching the appendage-engaging portions to the appendage-engaging assembly attachment ends for further enabling exercise.

18. The exercise apparatus of claim 17 wherein the appendage exercise assembly is further defined by comprising an appendage-engaging assembly selected from the group consisting of a hand-engaging grip and an ankle-encircling harness.

19. The exercise apparatus of claim 14 wherein the foot platform end is further defined by comprising roller means for movement.

20. The exercise apparatus of claim 14 wherein the foot platform end is further defined by comprising a foot platform-receiving sleeve and a reversible foot platform assembly, the foot platform assembly comprising a foot platform and a foot platform flange, the foot platform flange for superior or inferior insertion into the foot platform-receiving sleeve, the foot platform thus providing support to a user's body weight when in an engaged superior position or providing elevated support to the foot platform end when in an engaged inferior position.

21. The exercise apparatus of claim 14 wherein the exercise apparatus is selectively collapsible, whereby the carriage assembly is nestedly received within the rail-receiving track for enabling horizontal transferability.

22. A method of collapsing the exercise apparatus of claim 14, the method comprising the steps of:

removing the rail-riser rod from the first user-selected cooperative riser aperture pairing and the rail aperture pairing, thus detaching the carnage assembly from the riser assembly;

reinserting the rail-riser rod through an inferior most riser aperture pairing and the rail aperture pairing, thus reattaching the carriage assembly to the riser assembly;

removing the lateral support means from the inferior end;

unfastening the front riser member attachment ends from the riser members;

pivoting the front support rods in a forward manner about the front stabilizer member attachment ends to a substantially horizontal position;

pivoting the riser assembly and the rear support assembly in a forward manner about the inferior most riser aperture pairing and the rail aperture pairing to a substantially horizontal position;

unfastening the rear riser member attachment ends from the riser members;

pivoting both the rear stabilizer members about the anterior rear ends and the rear stabilizer rods about the rear stabilizer member attachment ends in a forward manner to a substantially horizontal position; thus collapsing the exercise apparatus such that the carriage assembly is nestedly received within the rail-receiving track for enabling horizontal transferability.

23. The method of collapsing the exercise apparatus of claim 22, whereby the method comprises the additional steps of:

removably attaching the front riser member attachment ends to the riser members after pivoting the front support rods in a forward manner about the front stabilizer member attachment ends to a substantially horizontal position; and removably attaching the rear riser member attachment ends to the riser members after pivoting both the rear stabilizer members about the anterior rear ends and the rear stabilizer rods about the rear stabilizer member attachment ends in a forward manner to a substantially horizontal position.

* * * * *